US006340426B1

(12) United States Patent
Uesugi

(10) Patent No.: US 6,340,426 B1
(45) Date of Patent: Jan. 22, 2002

(54) ELECTROLYTIC TREATMENT METHOD

(75) Inventor: Akio Uesugi, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/599,940

(22) Filed: Jun. 23, 2000

(30) Foreign Application Priority Data

Jun. 25, 1999 (JP) ..... 11-179788

(51) Int. Cl.[7] ..... B41N 3/03
(52) U.S. Cl. ..... 205/687; 205/704
(58) Field of Search ..... 205/687, 704

(56) References Cited

U.S. PATENT DOCUMENTS 4,597,837 A 7/1986 Oda et al. ..... 204/14.1
4,929,326 A 5/1990 Uesugi et al. ..... 204/206

FOREIGN PATENT DOCUMENTS

EP 0 349 983 A2 1/1990
EP 0 422 682 A2 4/1991
EP 0 816 118 A1 1/1998
JP 3-79800 4/1991
JP 2660582 6/1997

OTHER PUBLICATIONS

Japanese Abstract No. 03126900, dated May 30, 1991.

*Primary Examiner*—Arun S. Phasge
(74) *Attorney, Agent, or Firm*—Sughrue Mion, PLLC

(57) ABSTRACT

An electrolytic treatment method for manufacturing a planographic printing plate support body assures uniform surface-roughening and a predetermined rough surface. Graphite electrodes and an auxiliary electrode are arranged and installed in different electrolytic cells. A current is supplied to the auxiliary electrode by controlling a phase angle of waveforms generated by a power source as symmetrical alternating waveforms. The quantity of electrical power to the auxiliary electrode is set in the range of 0.5% to 9% of the total electrode electric power quantity. In addition, the resistance value of a support roller of an aluminum web is set to 0.01 MΩ or more and the frequency of the symmetrical alternating current waveform is set in the range of 50 Hz to 80 Hz. The current density of the main electrodes is set in the range of 5 A/dm$^2$ to 50 A/dm$^2$.

9 Claims, 4 Drawing Sheets

ELECTROLYTIC TREATMENT METHOD

BACKGROUND OF THE INVENTION

1. Field of the Invention

The present invention relates to an electrolytic treatment method for manufacturing a planographic printing plate support body in which an aluminum or an aluminum alloy is employed as a support body.

2. Description of Related Art

In general, in order to use an aluminum plate as a support element of a planographic printing plate, it is required to have appropriate adhesive properties to a photosensitive material and water preserving properties, and further, make the plate uniformly surface-roughened. Being uniformly surface-roughened means that the sizes of produced pits are appropriately equal, and requires that such pits are uniformly produced on their full faces. In addition, the pits considerably influence dirt retardant properties, printing resistance or the like that are printing performances of a printing plate material, and its quantity is an important factor for making a printing plate. Further, in recent years, a computer system for direct plate making from digital signals or the like is becoming popular with advancement of information system. In particular, with advancement of miniaturization and high yielding of solid laser and semiconductor laser beams, such computer system is becoming rapidly popular. It is also anticipated that a planographic printing plate support element restricts laser beam halation, and provides water preserving properties, hydrophilicity, printing resistance, and dirt retardant properties which are important for a printing plate.

As a recording material for infrared-ray laser beams, in Japanese Patent Publication No. 61-48418, there is disclosed an anodic oxidation support element having at least an oxide layer of 5 to 12 g/m$^2$. In addition, in Japanese Patent Laid-Open No. 63-260491, there is proposed a surface-roughened and anode-oxidized support element in which a sol having a nuclei to be reduced to a silver complex is adhered. In U.S. Pat. No. 4,555,475, there is proposed a support element silicate-treated on a surface having an anodic oxidation skin film to form a silicate of aluminum of 2 to 8 mg/m$^2$. In EP 164128B also, there is proposed a method for graining an aluminum surface, anodic oxidation, causing silicate treatment, applying a carbon black to make a photosensitive material, thereby forming an image. Further, in Japanese Patent Laid-Open No. 10-228992, there is proposed a support element for restricting halation. All of the patents assume a uniform rough surface. Such rough surface is made by mechanical surface-roughening method, electrochemical surface-roughening method, chemical etching technique or the like. Among them, the quality of the printing plate material is greatly influenced by electrochemical surface-roughening. It is an important task to make a high quality rough surface and to establish a production method having its stable mass productivity.

For example, the inventor et al. have proposed in Japanese Patent No. 2660582 that circuits for an auxiliary electrode are coupled with circuits connected to a main opposite electrode in parallel; a mechanism consisting of a diode-like action such as diode or thyristor for controlling the flow in the main opposite electrode of an anode current is provided at a power source or the circuits for the auxiliary opposite electrode; phase angle control is applied by each mechanism according to a phase angle of a waveform generated at the power source, and a control branch current is supplied.

In addition, in Japanese Patent No. 2581954, it is proposed that a sintered body containing magnetic iron oxide is employed for the auxiliary opposite electrode.

However, although the inventions of Japanese Patent Nos. 2660582 and 2581954 are superior inventions, it is required to provide an electrolytic treatment method for manufacturing a planographic printing plate support body capable of more uniform surface-roughening and maintaining a predetermined rough surface with recent advancement of direct laser output.

SUMMARY OF THE INVENTION

It is an object of the present invention to provide an electrolytic treatment method for manufacturing a planographic printing plate support body capable of more uniform surface-roughening and maintaining a predetermined rough surface.

In order to achieve the foregoing object, according to the present invention, there is provided an electrolytic treatment method for electrolytic treatment of a target material by liquid electric power supply using an alternating waveform current in an electrolytic treatment solution consisting essentially of nitric acids or hydrochloric acids existing in an electrolytic jar, the electrolytic treatment method being characterized in that the electrolytic jar is divided into two sections; electrodes installed in the divided electrolytic jar are defined as a main opposite electrode and an auxiliary opposite electrode installed in their respective different sections of the electrolytic jar; and an electricity quantity of the auxiliary opposite electrode is set in the range of 0.5% to 9% of a total electricity amount of the opposite electrode. In addition, the current supplied to the auxiliary opposite electrode can be supplied to the main opposite electrode and the auxiliary opposite electrode using a single electric source by constructing a circuit so as to supply the current to the auxiliary electrode by controlling a phase angle of the waveform generated by an alternating waveform power source.

Further, according to the present invention, a resistance value of a support member for supporting a target material is set to at least 0.01 MΩ.

Furthermore, according to the present invention, the frequency of the alternating waveform current is set in the range of 50 to 80 Hz, and the current density of the main opposite electrode is set in the range of 5 to 50 A/dm$^2$.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

Figure 1:
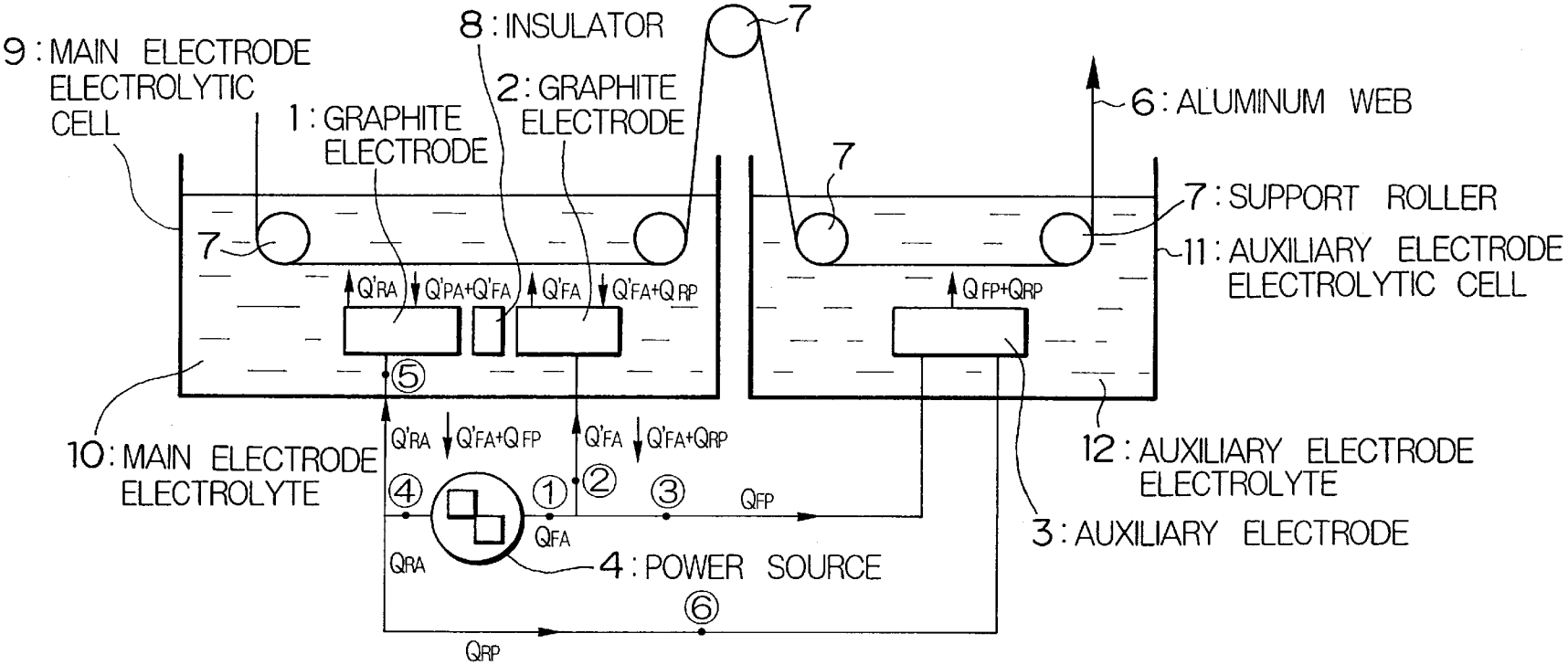
FIG. 1 is an illustrative view of a manufacturing apparatus to which a method for manufacturing a planographic printing plate support body according to the present invention is applied.

In the present invention, pure aluminum or aluminum alloy is contained in an aluminum plate to be used. As the aluminum alloy, various products can be used, and, for example, silicon, copper, manganese magnesium, chrome, zinc, lead, nickel, bismuth alloys and aluminum alloy are employed There are various aluminum alloys. As an offset printing plate material, for example, in Japanese Patent Publication No. 58-6635, Fe and Si components are limited, and an intermetal compound is specified. In addition, in Japanese Patent Publication No. 55-28874, cold rolling and intermediate annealing are carried out, and a method for applying a voltage to ensure electrolytic surface-roughening is limited. Not only aluminum alloys disclosed in the specifications of Japanese Patent Publication Nos. 62-41304, 1-46577, 1-46578, 1-47545, 1-35910, 63-60823, 63-60824, 4-13417, 4-19290, 4-19291, 4-19293, and 62-50540; Japanese Patent Laid-Open Nos. 61-272357, 62-74060, 61-201747, 63-143234, 63-143235, 63-255338, and 1-283350; EP 272528, U.S. Pat. No. 4,902,353 and 4,818,300; EP 394816, U.S. Pat. No. 5,010,188, West Germany Patent No. 3232810, U.S. Pat. No. 435,230, EP 239995, U.S. Pat. No. 4,822,715, West Germany Patent No. 3507402, U.S. Pat. No. 4,715,903, West Germany Patent No. 3507402, EP 289844, U.S. Pat. No. 5,009,722 and 4,945,004, West Germany Patent No. 3714059, U.S. Pat. No. 4,686,083 and 4,861,396, and EP 158941, but also general alloys are all included. A method for manufacturing a plate material using hot rolling and a method to be carried out with continuous casting are recently filed. For example, in the specification of East Germany Patent No. 252799, a plate material made by a double-roll system is introduced. In the specifications of EP 223737 and U.S. Pat. No. 4,802,935 and 4,800,950, plate materials in the form in which trace alloy components are limited are filed. In the specification of EP 415238, continuous casting and continuous casting+hot rolling are proposed.

In the present invention, various surface treatment, transfer or the like is carried out for such aluminum plate, whereby a print original plate having its uniform irregularities can be obtained, on which a photosensitive layer made of diazo compound or the like is provided, whereby a superior photosensitive planographic printing plate can be obtained. In any case, it is required to select a proper material.

In addition, occasionally, degreasing may be first carried out. In the case where degreasing process is carried out, a method in which a solvent such as trichloroethylene or a surface active agent is employed or an alkaline etching agent such as sodium hydroxide or potassium hydroxide is employed is widely employed. In Japanese Patent Laid-Open No. 2-026793, a description of degreasing process is given. For example, a solvent degreasing method employs petroleum-based solvents such as gasoline, kerosine, benzine, solvent naphtha, and normal hexane; and employs chlorine-based solvents such as trichloroethylene, methylene chloride, parchloroethylene, and 1, 1, 1-trichloroethane. An alkali degreasing method employs an aqueous solution of soda salts such as sodium hydroxide, sodium carbonate, sodium bicarbonate, and sodium sulfate; employs an aqueous solution of silicates such as sodium orthosilicate, sodium metasilicate, secondary sodium silicate, and tertiary sodium silicate; or employs phosphate an aqueous solution of phosphates such as monobasic sodium phosphate, tribasic sodium phosphate, dibasic sodium phosphate, sodium tripolyphosphate, sodium pyrophosphate, and sodium hexametaphosphate. When an alkali degreasing method is employed, there is a possibility that an aluminum surface is melted depending on a treatment time and a treatment temperature. As to the degreasing process, it is required that a melting phenomenon does not occur. The degreasing process with a surface active agent employs an aqueous solution of an anionic surface active agent, a cationic surface active agent, a non-ionic surface active agent, and an amphoteric surface active agent, and a variety of commercially available products or the like can be employed. The degreasing method includes immersion, blowing, and containing liquid in cloth or the like and rubbing or the like. In addition, ultrasonic waves may be employed for immersion or blowing.

Preliminary polishing using an electrochemical method is carried out in sulfuric acid solution by direct current electrolytic treatment. In this case, it is appropriate that a sulfic acid concentration is set in the range of 15% to 18%; a temperature is set in the range of 40 to 80° C.; a direct current is employed as power supply; a current density is set in the range of 5 $A/dm^2$ to 50 $A/dm^2$; and an electricity quantity is set in the range of 100 to 3000 $c/dm^2$. In the case where preliminary polishing is carried out mechanically, it is preferable that preliminary polishing is carried out by a roller produced by containing a polishing agent of 1 to 25 $\mu m$ in average particle size in a non-woven cloth composed of polyamide, polyester, rayon or the like. It is required to select a preliminary polishing condition capable of maintaining surface-roughness to a certain extent. It is preferable that the roller diameter is 200 to 1000 mm, and vibration of 5 to 2000 times per minute is applied in a direction perpendicular to a rolling direction of the original plate or in a direction perpendicular to line direction in the case of continuous processing in order to maintain a uniform face quantity. In any case, it is important that the center line surface-roughness is set to 0.15 to 0.35 $\mu m$ and the maximum surface-roughness is set to 1 to 3.5 $\mu m$ by preliminary polishing. In addition, in preliminary polishing, it is required to polish the aluminum surface by 0.1 $\mu m$ or more in order to remove a component that inhibits electrochemical surface-roughening.

When mechanical surface-roughening is carried out, there is a variety of methods employing brush, liquid honing or the like, which is required to select in consideration of productivity or the like.

A variety of transfer methods for bringing a ragged face into pressure contact with an aluminum plate can be used. That is, in addition to the methods disclosed in the aforementioned Japanese Patent Laid-Open Nos. 55-74898, 60-36195, and 60-203496, a method disclosed in Japanese Patent Laid-Open No. 6-55871, the method characterized in that transfer is carried out several times and a method disclosed in Japanese Patent Laid-Open No. 6-24168, the method characterized in that a surface is elastic are applicable.

In addition, using electric discharge processing, shot blasting, laser, or plasma etching, transfer is repeatedly carried out by employing a roller having fine irregularities engraved thereon or a face having its irregularities to which fine particulate is applied is brought into contact face with an aluminum plate on which a pressure is repeatedly applied in a plurality of lines, whereby an irregularity pattern corresponding to an average diameter of fine particulate may repeatedly be transcribed to the aluminum plate.

Methods for applying fine irregularities to the transfer roller are publicly known in Japanese Patent Laid-Open Nos. 3-08635, 3-066404, and 63-065017. In addition, a fine groove is cut on the roller surface in two directions using a die, cutting tool, or laser and the like, whereby rectangular irregularities may be provided on the surface. This roller surface is subject to publicly known etching process or the like, whereby processing may be carried out such that the formed irregularities are rounded. Of course, burning, hard chrome plating or the like may be carried out in order to increase the surface hardness.

Further, surface-roughening with brush includes surface-roughening with wire brush as well as surface-roughening with nylon brush or the like. Surface-roughening with high-pressure water is disclosed in Japanese Patent Laid-Open Nos. 59-21469, 60-19595, and 60-18390 or the like.

Thus, after the aluminum surface has been prepared with mechanical surface-roughening, the aluminum surface is chemically treated by acid or alkali for the purpose of smoothening an aluminum plate or making the plate uniform as required. Specific examples of acids or alkalis used for such chemical treatment include a method employing aqueous solution of soda salt such as phosphate, sulfate, chloride, nitrate, sodium hydroxide, sodium carbonate, sodium bicarbonate, or sodium sulfate; a method employing aqueous solution of silicate salt such as sodium orthosilicate, sodium metasilicate, secondary sodium silicate, or tertiary sodium silicate; a method employing aqueous solution of phosphate such as monobasic sodium phosphate, tribasic sodium phosphate, dibasic sodium phosphate, sodium tripolyphosphate, sodium pyrophosphate, or sodium hexametaphosphate. The treatment conditions are properly selected from concentration of 0.01 wt. % to 50 wt. %, temperature of 20° C. to 90° C., and time intervals of 5 seconds to 5 minutes. Preprocessing for electrochemical surface-roughening is proposed in Japanese Patent Laid-Open Nos. 54-65607 and 55-125299. Although a variety of preprocessing functions are included in Japanese Patent Laid-Open Nos. 63-235500, 63-307990, 1-127388, 1-160690, 1-136789, 1-136788, 1-178497, 1-308689, 3-126871, 3-126900, and 3-173800, the present invention is not limited thereto. However, when the aluminum surface is chemically treated by aqueous solution of acid or alkali in this way, an insoluble residue, i.e., smut is produced on its surface. This smut can be removed by phosphoric acid, nitric acid, sulfuric acid, chromic acid or these mixture. In the present invention, the aluminum surface to be electrochemically surface-roughened is desirably a clean face free of smut. However, in the case where an electrolyte is acidic, and has a de-smut action, removal of smut can be removed.

Figure 2:
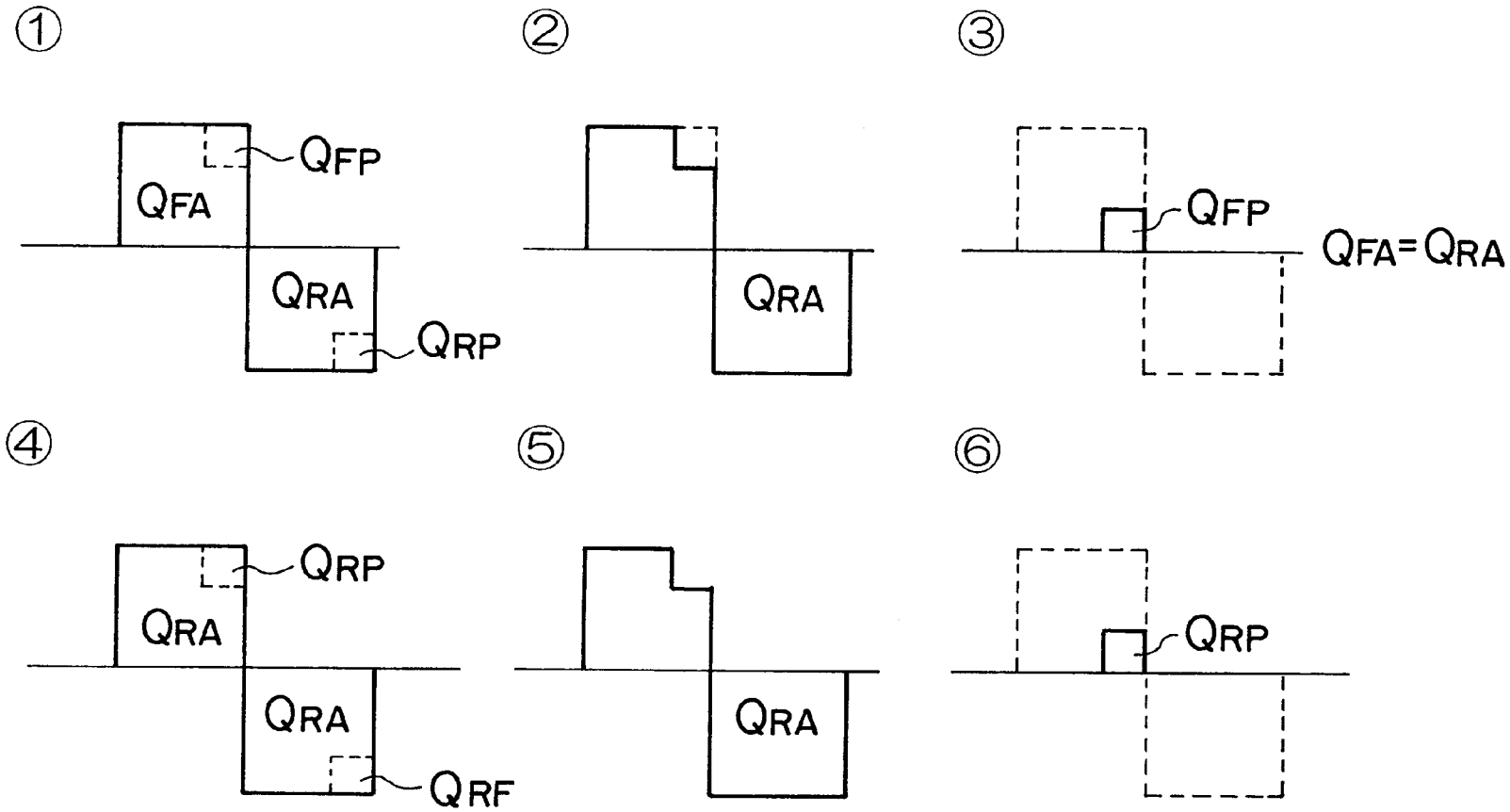
FIG. 2 is a waveform diagram depicting a current outputted from a power source of the manufacturing apparatus of FIG. 1.
Figure 3:
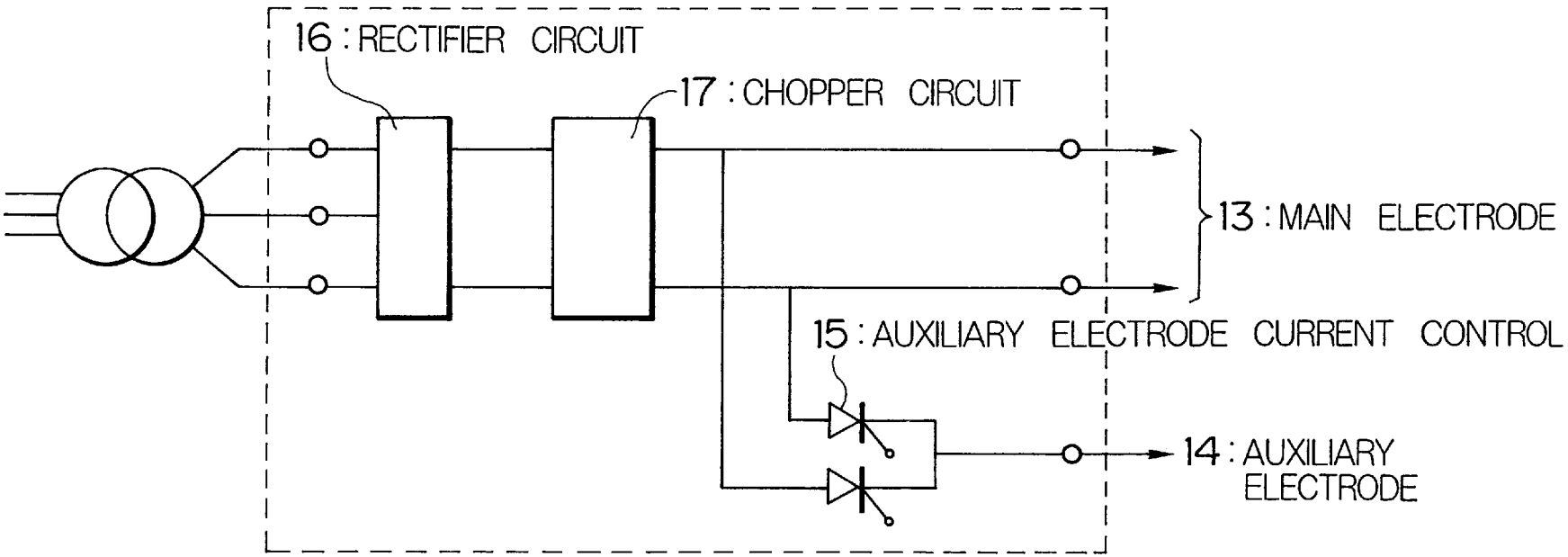
FIG. 3 is a control circuit diagram for controlling a phase angle.
Figure 4:
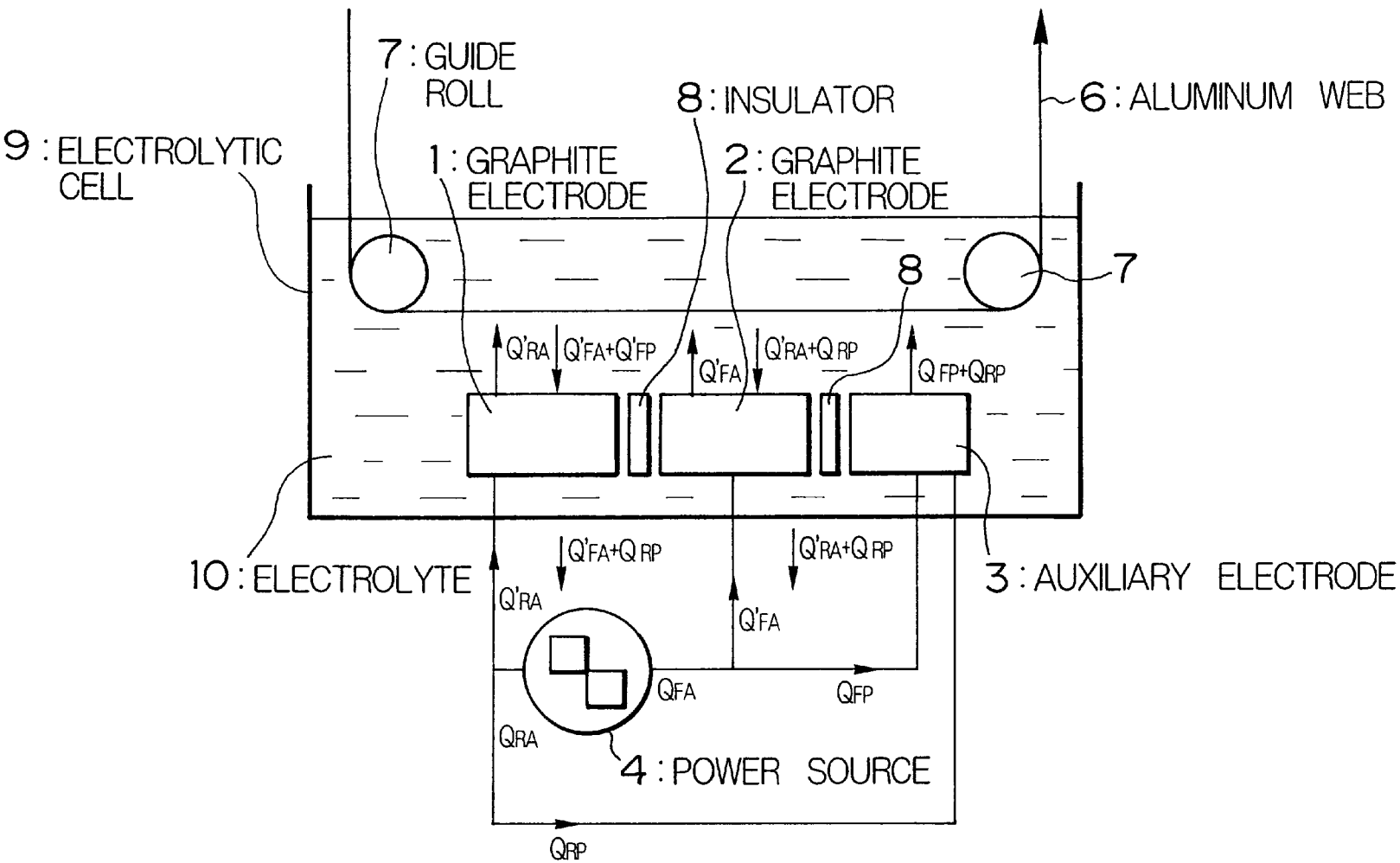
FIG. 4 is an illustrative view of an apparatus for manufacturing a conventional planographic printing plate support body.

FIG. 1 is an illustrative view illustrating an electrolytic treatment apparatus according to one embodiment of the present invention; FIG. 2 is a current waveform diagram; FIG. 3 is a control circuit diagram for controlling a phase angle; and FIG. 4 is a schematic view of a conventional electrolytic treatment apparatus.

In the electrolytic treatment apparatus of FIG. 1, an electrolytic cell (electrolytic jar) 9 of the main electrode and an electrolytic cell (electrolytic jar) 11 of the auxiliary electrode are two sections, and a plurality of support rollers (support members) 7, 7 . . . for carrying aluminum webs (target materials) 6 have insulating properties. The resistance value of the support roller 7 is preferably set to 0.01 MΩ or more, and the electricity quantity of the auxiliary opposite electrode 3 as a material is required to be 0.5 to 9% of a total electricity quantity. If the electricity quantity is less than 0.5%, the graphite electrode 1 of the main electrode is exhausted. If it exceeds 9%, a uniform pit is hardly generated. Preferably, the electricity quantity ranges from 1 to 7%. More preferably, it ranges from 3 to 6%. The value of a current supplied to the auxiliary electrode is preferably ±10%, and is more preferably ±5%.

In FIG. 1, reference numeral 1 denotes a graphite electrode disposed opposite to an aluminum web 6; reference numeral 2 denotes a graphite electrode disposed oppositely in the same manner; and reference numeral 3 denotes an auxiliary opposite electrode disposed oppositely in the same manner, wherein a phase is controlled at a power source 4, and only an anode current is supplied. The power source 4 is connected to the graphite electrode 1 and the auxiliary opposite electrode 3 with one end of the power source being branched, and is connected to the graphite electrode 2 and the auxiliary opposite electrode 3 with the other end being branched. Although it is not shown, the power source 4 or the auxiliary electrode 3 has a mechanism consisting of diode-like action for controlling the flow of the anode current to the main opposite electrode 1 or 2, and the power source 4 outputs power waveforms as shown in ① to ② of FIG. 2. In this case, $Q_{FA}$ is equal to $Q_{RA}$, and forward and reverse currents supplied to the auxiliary opposite electrode 3 are controlled according to a phase angle.

FIG. 2 shows the waveforms in ① to ⑥ shown in FIG. 1.

The phase angle is thus controlled, and the current is supplied to the auxiliary opposite electrode 3, whereby $Q'_{RA}<Q'_{FA}+Q_{FP}=Q_{FA}$ is met in the graphite electrode 1, and $Q'_{FA}<Q'_{RA}+Q_{RP}=Q_{RA}$ is met in the graphite electrode 2, and decomposition of the graphite electrode can be prevented.

The power source 4 meets a condition of $Q_{FA}=Q_{RA}$, ($Q_{FA}=Q'_{FA}+Q_{FP}$, $Q_{RA}=Q_{RA}+Q_{RP}$).

Reference numeral 7 denotes a support roller for supporting the aluminum web 6 so that a clearance between the aluminum web 6 and graphite electrodes 1 and 2 and the auxiliary opposite electrode 3 is constant; reference numeral 8 denotes an insulator; reference numeral 9 denotes an electrolytic cell; reference numeral 10 denotes an electrolyte, wherein the electrolyte may be circulated by a pump or a heat exchanger and a filter may be installed partially of the circulation system. A temperature controller is installed in a circulation system, and an electrolyte may be separated from and free from impurities. A phase angle of the power source 4 is generally controlled by a thyristor as illustrated in FIG. 3. That is, in FIG. 3, reference numeral 16 denotes a rectifier circuit; reference numeral 17 denotes a chopper circuit; reference numeral 13 denotes a circuit whose current is supplied to the main electrode (graphite electrodes 1 and 2 in FIG. 1); reference numeral 14 denotes a circuit whose current is supplied to the auxiliary opposite electrode 3; and reference numeral 15 denotes a control circuit consisting of a tyristor incorporated in parallel in an output of the chopper circuit 17 in order to control a phase angle of the auxiliary opposite electrode 3.

On the other hand, as the auxiliary opposite electrode 3, there can be used the electrodes of clad type consisting of platinum and titanium, plating type, those made of a combination of platinum and tantalum, those made of a combination of iridium oxide and titanium, ferrite electrode or the like. It is important to well establish the current conditions, electrode material quality, and electrolyte concentration so as not to cause the electrode to be exhausted. In order to prevent the electrode from being exhausted, it is required to set the electricity quantity to 0.5% or more of a total electricity quantity. In order to obtain uniform graining, it is required to set the electricity quantity to 9% or less of a total electricity quantity. More preferably, the electricity quantity is from 1% to 8%. Further more preferably, the quantity is from 2% to 7%.

Electrochemical surface-roughening is disclosed in the specifications of Japanese Patent Publication No. 48-28123 and British Patent No. 896563. In the above electrolytic graining, although a sine wave alternating current is employed, a specific wave as disclosed in Japanese Patent Laid-Open No. 52-58602 may be employed. In addition, there can be applied methods disclosed in Japanese Patent Laid-Open Nos. 55-158298, 56-28898, 52-58602, 52-152302, 54-85802, 60-190392, 58-120531, 63-176187, 1-5889, 1-280590, 1-118489, 1-148592, 1-178496, 1-188315, 1-154797, 2-235794, 3-260100, 3-253600, 4-72079, 4-72098, 3-267400, and 1-141094.

In addition to the aforementioned ones, frequencies proposed in an electrolyte capacitor can be used, for example, in the specifications of U.S. Pat. No. 4,276,129 and 4,676,879 or the like.

In addition to the aforementioned electrolytes such as nitric acid or hydrochlonic acid, there can be used electrolytes disclosed in U.S. Pat. No. 4,671,859, 466,576, 4,661,219, 4,618,405, 462,628, 4,600,482, 4,566,960, 4,566,958, 4,566,959, 4,416,972, 4,374,710, 4,336,113, 4,184,932 or the like. Various electrolytic cells and power sources are proposed in the specifications of U.S. Pat. No. 4,203,637 and Japanese Patent Laid-Open Nos. 56-123400, 57-59770, 53-12738, 53-32821, 53-32822, 53-32823, 55-122896, 55-132884, 62-127500, 1-52100, 1-52098, 60-67700, 1-230800, 3-257199 or the like. In addition to the above mentioned patents, various electrolyte jars and power sources are proposed. For example, of course, there can be applied those disclosed in Japanese Patent Laid-Open Nos. 52-58602, 52-152302, 53-12738, 53-12739, 53-32821, 53-32822, 53-32833, 53-32824, 53-32825, 54-85802, 55-122896, and 55-132884; Japanese Patent Publication Nos. 48-28123 and 51-7081; and Japanese Patent Laid-Open Nos. 52-133838, 52-133840, 52-133844, 52-133845, 53-149135, and 54-146234.

Smut removal is carried out by using a liquid having components identical to those of an electrolyte as described previously. If smut removal is carried out by using a liquid having components different from those of an electrolyte, water washing process is required after the smut removing process, which contributes to an increase in cost, and affects electrolytic grain properties. With the same component, even if such smut removal is carried out in a system in which a temperature or concentration is changed, it is possible to manage or control the temperature and concentration in the electrolytic surface-roughening process. Although the smut removing method includes chemically dissolving the smut, the liquid is allowed to collide with a web at a high speed with spraying or the like, whereby the smut may be forcibly removed. In any case, the method may be selected comprehensively considering productivity, facility cost, cell shape for electrolytic surface-roughening. In any system, it is essential to remove the smut by 5% to 70% in quantity. The smut generated due to electrolytic surface-roughening changes by about 0.2 $\mu m^2$ to 5 $g/m^2$ in quantity under electrolytic conditions, and thus, the quantity of smut may be changed in this range in order to remove the smut in the target quality and performance.

The thus obtained aluminum plate is subject to alkali or acid treatment as required. The aluminum plate is alkali treated as in Japanese Patent Laid-Open No. 56-51388, and is de-smutted by sulfate as in Japanese Patent Laid-Open No. 53-12739. In addition, the aluminum plate is phosphate treated as in Japanese Patent Laid-Open No. 53-115302, and there can be employed the methods disclosed in Japanese Patent Laid-Open Nos. 60-8091, 63-176188, 1-38291, 1-127389, 1-188699, 3-177600, 3-126891, 3-191100 or the like.

In this manner, after surface-roughening and etching has been carried out by mechanical surface-roughening, chemical etching, or electrochemical surface-roughening, irregularities are generated. In order to engrave protrusions, a thread shaped fiber of 5 to 500 $\mu m$ in diameter is employed. When the fiber is less than 5 $\mu m$ in diameter, a tip end cannot be engraved. When it exceeds 500 $\mu m$ in diameter, the surface is damaged, and the fiber is hardly used as a planographic printing plate. In addition, preferably, the diameter is 10 to 100 $\mu m$. More preferably, it is 15 to 50 $\mu m$. The diameter is obtained from the average value by taking 10 or more enlarged SEM photographs or the like. As a material, chemical fibers such as 6-nylon, 6–10 nylon or the like, animal hair or the like are employed. As a binder for bonding the nylon or the like, acryl, NBR or the like is employed. In addition, it is required to continuously treat an aluminum plate in order to improve productivity. In such a case, such fiber is roll-shaped, and is rotated at a high speed, thereby engraving protrusions. In the case of making a roll-shaped fiber, if the hardness of the roll surface is too hard, the aluminum surface is easily damaged, and thus, the hardness of the roll is required to be 60 degrees or less. The hardness is measured in conformance with SRISO101 (Japanese Rubber Association Standards) and JISS6050, and a spring type hardness testing instrument, Asker model C is employed as a measuring instrument. The peripheral speed of roll is properly 50 to 2000 m per minute, and rolling can be carried out stably by supplying water for the purpose of prevention of overheating or the like.

This process is carried out after surface-roughening or etching has been carried out by mechanical surface-roughening, chemical etching, or electrochemical surface-roughening. The above process may be carried out after all the steps have been completed or may be carried out after one step of surface-roughening of all the steps, i.e., after the etching step. The process can be varied depending on the required quality.

On the surface of the thus obtained aluminum support element, it is preferable to form an anodic oxidation skin film. When a current is applied using aluminum as an anode in an aqueous solution or non-aqueous solution of sulfuric acid, phosphoric acid, chromic acid, oxalic acid, sulfamic acid, benzene sulfonic acid and the like or a combination of two or more of these as an electrolyte, the anodic oxidation skin film can be formed on the aluminum surface. The treatment conditions for anodic oxidation change variously depending on an electrolyte to be used, and thus, it is difficult to approximately define the conditions. In general, it is proper that the concentration of an electrolyte is 1–80 wt. %, the liquid temperature is 5–70° C., the current density is 0.5–60 $A/cm^2$, the voltage is 1–100 V, and the electrolyzing time is 15 seconds to 50 minutes. The electrolyzing devices are introduced in Japanese Patent Laid-Open Nos. 48-26638 and 47-18739; and Japanese Patent Publication No. 58-24517. In addition, there can be used, of course, methods disclosed in Japanese Patent Laid-Open Nos. 54-81133, 57-47894, 57-51289, 57-51290, 57-54300, 57-136596, 58-107498, 60-200256, 62-136596, 63-176494, 4-176897, 4-280997, 6-207299, 5-32083, 5-125597, and 5-195291. There can be used, of course, treatment liquids disclosed in Japanese Patent Laid-Open Nos. 3-253596, 62-82089, 1-133794, 54-32424, 5-42783 or the like.

As described above, after the anodic oxidation skin film is formed, an anodic oxidation skin film is etched in order to optimize adhesion between each support element and a photosensitive composition. Then, pore sealing treatment is carried out by steam and hot water. As a result, there is provided a pore sealing treatment apparatus for a support element imparting a photosensitive printing plate having its good stability with an elapse of time and good developing properties, and free of dirt at the non-image portion (Japanese Patent Publication No. 56-12518). Post-processing for generating a skin film may be carried out in such apparatus. In addition, pore sealing treatment may be carried out with the apparatuses and methods disclosed in Japanese Patent Laid-Open Nos. 4-4194, 5-202496, and 5-179482.

Further, there can be applied potassium zirconium acid fluoride treatment disclosed in the specification of U.S. Pat. No. 2,946,638; phosphomolybdate treatment disclosed in the specification of U.S. Pat. No. 3,201,247; alkyl titanate treatment disclosed in the specification of British Patent No. 1108559; polyacrylic acid treatment disclosed in the specification of German Patent No. 1091433; polyvinyl phosphonic acid treatment disclosed in the specification of German Patent No. 1134093 or British Patent No. 1230447; phosphonic acid treatment disclosed in Japanese Patent Publication No. 44-6409; phytic acid treatment disclosed in the specification of U.S. Pat. No. 3,307,951; treatment which a divalent metal salt of a lipophilic organic polymeric compound disclosed in Japanese Patent Laid-Open No. 58-16893 or 58-18291; providing an undercoat layer of hydrophilic cellulose (for example, carboxymethyl cellulose) containing a water-soluble metal salt (for example, zinc acetate) as disclosed in the specification of U.S. Pat. No. 3,860,426; undercoating a water-soluble polymer having a sulfonic acid radical, thereby making it hydrophilic disclosed in Japanese Patent Laid-Open No. 59-101651; undercoating of phosphate disclosed in Japanese Patent Laid-Open No. 62-019494; of a water-soluble epoxy compound disclosed in Japanese Patent Laid-Open No. 62-033692; of phosphate-modified starch disclosed in Japanese Patent Laid-Open No. 62-097892; of diamine compound disclosed in Japanese Patent Laid-Open No. 63-056498; of inorganic or organic animo acid disclosed in Japanese Patent Laid-Open No. 63-130391; of organic phosphonic acid containing a carboxyl group or hydroxyl group disclosed in Japanese Patent Laid-Open No. 63-145092; of a compound having an amino group and a phosphonic acid radical disclosed in Japanese Patent Laid-Open No. 63-165183; of a specific carboxylic acid derivative disclosed in Japanese Patent Laid-Open No. 2-316290; of a phosphate ester disclosed in Japanese Patent Laid-Open No. 1-272594; of compound having one amino group and one phosphorous oxygen acid radical disclosed in Japanese Patent Laid-Open No. 3-261592; of phosphate ester disclosed in Japanese Patent Laid-Open No. 3-215095; of aliphatic or aromatic phosphonic acid such as phenylphosphonic acid disclosed in Japanese Patent Laid-Open No. 5-246171; compound containing S atoms such as thiosalicylic acid disclosed in Japanese Patent Laid-Open No. 1-307745 and of a compound having a phosphorous oxygen acid radical disclosed in Japanese Patent Laid-Open No. 4-282637; and coloring with acidic dye disclosed in Japanese Patent Laid-Open No. 60-64352.

It is preferable that the support body according to the present invention has the following features.

Re: Characteristics of graining shape

When an aluminum plate grained by the surface-roughening step is used as a planographic printing plate support body, the aluminum plate is desired to have the following characteristics.

① The surface roughness of the center line (JIS-B0601-1970) is desirably 0.3 to 1.0 μm, and more desirably 0.4 to 0.8 μm. In addition, the average surface roughness of the photosensitive layer surface after development is preferably 0.35 μm or more. Further, a relative load length is preferably 90% or more at a site lower than 50% of the cutting level of the load curve measured by the surface roughness meter by 1.5 μm. The center line surface roughness is preferably 0.9 to 1.5 times when electrochemical surface-roughening, chemical etching, or de-smut treatment is applied to the center line surface roughness subjected to mechanical surface-roughening, chemical etching, and de-smut treatment.

② The values for material properties measured by atomic force microscope (AFM) are preferably 5 to 40% when the tilt angle of surface tilt distributions is 30 degrees, and are 5 to 50% at the rate of 45 degrees or more. In addition, the square average surface roughness is preferably within the range of the following.

$1.5 \leqq R_{ms}(10 \text{ to } 100\ \mu m)/R_{ms}(1 \text{ to } 10\ \mu m) \leqq 3.0$ $0.2 \leqq R_{ms}(1 \text{ to } 10\ \mu m) \leqq 0.4\ \mu m$ $0.4 \leqq R_{ms}(10 \text{ to } 100\ \mu m) \leqq 1.0\ \mu m$ In addition, the comparative area is preferably from 1.1 to 1.6.

③ As irregularities of the aluminum plate, graining patterns having large waves of 5 to 30 μm in average pitch and grains of 0.5 to 3 μm in size superimposed on each other are preferable. It is particularly preferable that grains of 0.5 to 2 μm are uniformly generated, and the pit density is $1\times10^5$ to $1\times10^7$ pieces/mm$^2$. In addition, when the diameter of an opening pore and the degree of accumulation (%) are drawn on horizontal and vertical axes, respectively, the diameter of the opening pore corresponding to an accumulation degree curve of 5% and 95% is preferably 0.8 μm to 15 μm. The calculated average of the pore size is 0.5 to 5 μm. An area A which does not include pores on the surface or having only pores of 0.5 μm in maximum size is preferably smaller than 30% of the surface area.

The support element according to the present invention is provided with a photosensitive layer embodied below to make a photosensitive planographic printing plate.

[I] When a Photosensitive Layer Containing o-naphthoquinonediazide Sulfonic Acid Ester and Phenol Cresol Mixed Novolac Resin is Provided o-quinonediazide compounds are o-naphthoquinonediazide compounds, and are disclosed in a number of publications including the specifications of U.S. Pat. No. 2,766,118, 2,767,092, 2,772,972, 2,859,112, 3,102,809, 3,106,465, 3,635,709, and 3,647,443. These compounds can be preferably used. Particularly preferred among them are o-naphthoquinonediazide sulfonic acid esters or o-naphthoquinonediazide carboxylic acid esters of aromatic hydroxy compounds; and o-naphthoquinonediazide sulfonic acid amides or o-naphthoquinonediazide carboxylic acid amides of aromatic animo compounds. In particular, very excellent are ester reaction product of o-naphthoquinonediazide sulfonic acid with a condensation product of pyrogallol and acetone disclosed in the specification of U.S. Pat. No. 3,635,709; ester reaction product of o-naphthoquinonediazide sulfonic acid or o-naphthoquinonediazide carboxylic acid with a polyester having a hydroxy group at its end disclosed in the specification of U.S. Pat. No. 4,028,111; ester reaction product of o-naphthoquinonediazide sulfonic acid or o-naphthoquinonediazide carboxylic acid with a p-hydroxy styrene homopolymer or copolymer with other copolymerizable monomers as disclosed in British Patent No. 1,494,043; amide reaction product of. o-naphthoquinonediazide sulfonic acid or o-naphthoquinonediazide carboxylic acid with a copolymer of p-amino styrene and other copolymerizable monomers as disclosed in the specification of U.S. Pat. No. 3,759,711.

These o-quinonediazide compounds can be used singly, but it is preferable to use them mixed with an alkali-soluble resin. Preferable alkali-soluble resins include novolac type phenol resins, specifically phenol formaldehyde resins, o-cresol formaldehyde resins, m-cresol formaldehyde resins or the like. Further, it is more preferable to use the above-mentioned phenol resin together with a condensation product of phenol substituted by an alkyl group having 3 to 8 carbons or cresol and formaldehyde such as t-butyl phenol formaldehyde resin as disclosed in the specification of U.S. Pat. No. 4,028,111.

In addition, in order to form a visible image with exposure, there are added compounds such as o-naphthoquinonediazide-4-sulfonyl chloride; inorganic anion salt of p-diazodiphenyl amine; trihalomethyloxadiazol compound; trihalomethyloxadiazol compound having a benzofuran ring or the like. Image coloring agents include triphenyl methane dyes such as Victoria Blue BOH, Crystal Violet, and Oil blue. A dye disclosed in Japanese Patent Laid-Open No. 62-293247 is particularly preferred.

Further, grease sensing agents can include a phenol substituted by an alkyl group having 3 to 15 carbons as disclosed in Japanese Patent Publication No. 57-23253, for example, t-butyl phenol, N-octyl phenol, a novolac resin obtained by condensation of t-butyl phenol and formaldehyde, or o-naphthoquinonediazide-4 or -5-sulfonic acid ester of such novolac resin (disclosed in Japanese Patent Laid-Open No. 61-242446, for example).

Furthermore, in order to improve developing properties, it can contain a non-ionic surface active agent as disclosed in Japanese Patent Laid-Open No. 62-251740.

The above composition is dissolved in a solvent for solving each of the components, and is applied onto the support element. Solvents to be used here include ethylene dichloride, cyclohexanone, methyl ethyl ketone, ethylene glycol monomethyl ether, etylene glycol monoethyl ether, 2-methoxy ethyl acetate, 1-methoxy-2-propanol, 1-methoxy-2-propyl acetate, methyl lactate, ethyl lactate, dimethyl sulfoxide, dimethyl acetoamide, dimethyl formamide, water, N-methyl pyrrolidone, tetrahydroflulfuryl alcohol, acetone, diacetone alcohol, methanol, ethanol, isopropanol, diethylene glycol dimethyl ether or the like, and these solvents are used singly or in mixture.

A photosensitive composition comprising these components is provided as a solid component by 0.5 to 3.0 g/m$^2$.

[II] When a Photosensitive Layer Containing a Diazo Resin and a Water-insoluble and Lipophilic Polymeric Compound is Provided Diazo resins include, for example, organic-solvent-soluble diazo resin in organic salts that are reaction products of a condensation product of p-diazodiphenyl amine and formaldehyde or acetoaldehyde; and hexafluorophosphate or tetrafluoro borate; and organic-solbent-soluble diazo resin inorganic salts that are reaction products of the above condensation product and sulfonic acids, for example, p-toluenesulfonic acid or its salts; phosphinic acids, for example, benzenephosphinic acid or its salts; and hydroxyl-group-containing compounds, for example, 2, 4-dihydroxy benzophenone, 2-hydroxy-4-methoxybenzophenone-5-sulfonic acid or its salts as disclosed in the specification of U.S. Pat. No. 3,300,309.

In the present invention, other diazo resins that can be preferably employed include co-condensation products containing as a structural unit, aromatic compounds having at least one organic group of a carboxyl group, sulfonic acid radical, sulphinic acid radical, phosphorous oxygen acid radical, and hydroxyl group; and diazonium compounds, preferably aromatic diazonium compounds.

Preferably, the above aromatic rings can include a phenyl group or a naphthyl group.

There are exemplified various aromatic compounds containing at least one of the aforementioned carboxyl group, sulfonic acid radical, sulphinic acid radical, a phosphorous oxygenic acid radical, and hydroxyl group. Preferably, these include 4-methoxy benzoic acid, 3-chlorobenzoic acid, 2, 4-dimethoxy benzoic acid, p-phenoxy benzoic acid, 4-anilinobenzoic acid, phenoxy acetatic acid, phenyl acetatic acid, p-hydroxy benzoic acid, 2, 4-dihydroxy benzoic acid, benzene sulfonic acid, p-toluene sulphinic acid, 1-naphthalene sulfonic acid, phenyl phosphonic acid, phenyl phosphonic acid or the like. A diazonium salt as disclosed in Japanese Patent Publication No. 49-48001, for example, can be employed for an aromatic diazonium compound as a constituent unit of the aforementioned co-condensed diazo resin, and in particular, diphenyl amine-4-diazonium salts are preferred.

Diphenylamine-4-diazonium salts are derived from 4-amino-diphenyl amines. Such 4-amino-diphenyl amines includes 4-amino diphenyl amine, 4-amino-3-methoxy diphenyl amine, 4-amino-2-methoxy diphenyl amine, 4'-amino-2-methoxy diphenyl amine, 4'-amino-4-methoxy diphenyl amine, 4-amino-3-methyl diphenyl amine, 4-amino-3-ethoxy diphenyl amine, 4-amino-3-β-hydroxy ethoxy diphenyl amine, 4-amino-diphenyl amine-2-sulfonic acid, 4-amino-diphenyl amine-2-carboxyl acid, 4-amino-diphenyl amine-2'-carboxylic acid or the like. 3-methoxy-4-amino-4-diphenyl amine and 4-amino diphenyl amine are particularly preferred.

In addition, as diazo resins other than diazo resins co-condensed with an aromatic compound having an acid radical, aldehyde containing an acidic radical and diazo resins condensed with its acetal compound disclosed in Japanese Patent Laid-Open Nos. 4-18559, 3-163551, and 3-253857 can be preferably used.

Paired anions of diazo resins include anions that constantly form salts with diazo resins, and that make the resins soluble in organic solvent. These include organic carboxylic acids such as decanoic acid and benzoic acid; organic phosphonic acids such as phenyl phosphoric acids; and sulfonic acids. Typical examples include aliphatic and aromatic sulfonic acids such as methanesulfonic acid, fluoroalkane sulfonic acid such as trifluoro methanesulfonic acid, lauryl sulfonic acid, dioctyl sulfonesuccinic acid, dicyclohexyl sulfonesuccinic acid, campher-sulfonic acid, tolyloxy-3-propane sulfonic acid, nonyl phenoxy-3-propane sulfonic acid, nonyl phenoxy-4-butane sulfonic acid, dibutyl phenoxy-3-propane sulfonic acid, diamyl phenoxy-3-propane sulfonic acid, dinonyl phenoxy-3-propane sulfonic acid, dibuthyl phenoxy-4-butane sulfonic acid, dinonyl phenoxy-4-butane sulfonic acid, benzene sulfonic acid, toluene sulfonic acid, mesitylene sulfonic acid, p-chlorobenzene sulfonic acid, 2, 5-dichlorobenzene sulfonic acid, sulfosalicylic acid, 2, 5-dimethyl benzene sulfonic acid, p-acetyl benzene sulfonic acid, 5-nitro-o-toluene sulfonic acid, 2-nitrobenzene sulfonic acid, 3-chlorobenzene sulfonic acid, 3-bromobenzene sulfonic acid, 2-chloro-5-nitrobenzene sulfonic acid, butyl benzene sulfonic acid, octyl benzene sulfonic acid, decyl benzene sulfonic acid, dodecyl benzene sulfonic acid, butoxy benzene sulfonic acid, dodecyloxybenzene sulfonic acid, 2-hydroxy-4-methoxy benzophenone-5-sulfonic acid, isopropyl naphthalene sulfonic acid, butyl naphthalene sulfonic acid, hexyl naphthalene sulfonic acid, octyl naphthalene sulfonic acid, buthoxy naphthalene sulfonic acid, dodecyloxynaphthalene sulfonic acid, dibutyl naphthalene sulfonic acid, dioctyl naphthalene sulfonic acid, triisopropyl naphthalene sulfonic acid, tributyl naphthalene sulfonic acid, 1-naphthol-5-sulfonic acid, naphthalene-1-sulfonic acid, naphthalene-2-sulfonic acid, 1, 8-dinitro-naphthalene-3, 6-disulfonic acid, and dimethyl-5-sulfoisonaphthalate; hydroxyl group-containing aromatic compounds such as 2, 2', 4, 4'-tetrahydroxy benzophenone, 1,2,3-trihydroxy benzophenone, 2,2',4-trihydroxy benzophenone; halide Lewis acids such as hexafluorophosphoric acid and tetrafluoroboric acid, and perhalogenic acids such as $HClO_4$ and HI04 without being limited thereto. Among them, butyl naphthalene sulfonic acid, dibutyl naphthalene sulfonic acid, hexafluorophosphonic acid, 2-hydroxy-4-methoxybenzophenone-5-sulfonic acid, and dodecyl benzene sulfonic acid are particularly preferred.

For the diazo resins used in the present invention, molecular weight can be obtained as an arbitrary value by variously changing the molar ratio of each monomer and condensation conditions. In order to effectively use the diazo resins for target applications of the present invention, it is preferable that the molecular weight is about 400 to 100,000, preferably, about 800 to 8,000.

Water-insoluble and lipophilic polymeric compounds include copolymers with molecular weights generally of 10,000 to 200,000, in which monomers shown in the following (1) to (17) are their structural units.

(1) Acrylamides, methacrylamides, acrylate esters, methacrylic acid esters, and hydroxy styrenes having aromatic hydroxyl group, for example, N-(4-hydroxyphenyl) acrylamide or N-(4-hydroxyphenyl) methacrylamide, o-, m-, p-hydroxy styrene, o-, m-, p-hydroxy phenyl-acrylate or methacrylate;

(2) Acrylic acid esters and methacrylic acid esters having an aliphatic hydroxyl group, for example, 2-hydroxy ethyl acrylate or 2-hydroxy ethyl methacrylate, or 4-hydroxy butyl methacrylate;

(3) Unsaturated carboxylic acid such as acrylic acid, methacrylic acid, maleic anhydride, or itaconic acid;

(4) (Substituted) alkyl acrylate such as methyl acrylate, ethyl acrylate, propyl acrylate, butyl acrylate, amyl acrylate, hexyl acrylate, cyclohexyl acrylate, octyl acrylate, benzyl acrylate, 2-chloroethyl acrylate, acrylate glycidyl, N-dimethyl amino ethyl acrylate;

(5) (Substituted) alkyl methacrylate such as methyl methacrylate, ethyl methacrylate, propyl methacrylate, butyl methacrylate, amyl methacrylate, cyclohexylmethacrylate, benzyl methacrylate, glycidyl methacrylate, or N-dimethyl amino ethyl methacrylate;

(6) Acrylamides or methacrylamides such as acrylamide, methacrylamide, N-methylol acryl amide, N-methylol methacrylamide, N-ethyl acrylamide, N-hexyl methacrylamide, N-cyclohexyl acrylamide, N-hydroxy ethyl acrylamide, N-phenyl acrylamide, N-nitrophenyl acrylamide, or N-ethyl-N-phenyl acrylamide;

(7) Vinyl ethers such as ethyl vinyl ether, 2-chloroethyl vinyl ether, hydroxy ethyl vinyl ether, propyl vinyl ether, butyl vinyl ether, octyl vinyl ether, or phenyl vinyl ether;

(8) Vinyl esters such as vinyl acetate, vinyl chloroacetate, vinyl butylate, or vinyl benzoate;

(9) Styrenes such as styrene, a-methyl styrene, or chloromethylstyrene;

(10) Vinyl ketones such as methyl vinyl ketone, ethyl vinyl ketone, propyl vinyl ketone, or phenyl vinyl ketone;

(11) Olefins such as ethylene, propylene, isobutylene, butadien, isoprene;

(12) N-vinylpyrolidone, N-vinylcarbazole, 4-vinylpyridine, acrylonitryl, methacrylonitryl or the like;

(13) Unsaturated imides such as maleimide, N-acryloyl acrylamide, N-aceketyl methacrylamide, N-propionyl methacrylamide, N-(p-chlorobenzoyl) methacrylamide;

(14) Methacrylic acid amides such as N-(o-aminosulfonylphenyl) methacrylamide, N-(m-aminosulfonylphenyl) methacrylamide, N-(p-amino) sulfonyl phenyl methacrylamide, N-(1-(3-amino sulfonyl)naphtyl) methacrylamide, or N-(2-amino sulfonyl ethyl) methacrylamide and acrylamides having a substituent similar to the above; or methacrylic acid esters such as o-amino sulfonyl phenyl bumethacrylate, m-amino sulfonyl phenyl methacrylate, p-amino sulfonyl phenyl methacrylate, 1-(3-amino sulfonyl naphtyl) methacrylate and unsaturated sulfonic amides such as acrylate esters having a substituent similar to the above;

(15) Unsaturated monomer having cross linking group on its side chain such as N-(2-(methacryloyloxy)-ethyl)-2, 3-dimethyl maleimide, and vinyl cinnamate. Further, monomers that can be co-polymerized with any of the above monomers may be co-polymerized.

(16) Phenol resin disclosed in the specification of U.S. Pat. No. 3,751,257 and polyvinyl acetal resin such as polyvinyl formal resin or polyvinyl butyral resin; or

(17) Polymeric compounds which make polyurethane alkali-soluble, disclosed in Japanese Patent Publication No. 54-19773; and Japanese Patent Laid-Open Nos. 57-904747, 60-182437, 62-58242, 62-123452, 62-123453, 63-113450, and 2-146042.

To the above copolymers, a polyvinyl butyral resin, a polyurethane resin, a polyamide resin, an epoxy resin, a novolac resin, a natural resin or the like may be added as required.

For photosensitive compositions employed for the support element according to the present invention, pigments can be employed for the purpose of obtaining visible images due to exposure and visible images after development.

The pigments include triphenyl methane-based, diphenyl methane-based, oxazine-based, xanthene-based, iminonaphthoquinone-based, azomethine-based, or anthraquinone-based pigments represented by Victoria Pure Blue BOH (available from Hodogaya Chemicals Co., Ltd.), Oil Blue #603 (available from Orient Chemical Engineering Co., Ltd.), Patent Pure Blue (available from Sumitomo Mikuni Chemicals Co., Ltd.), Crystal Violet; Brilliant Green, Ethyl Violet; Methyl Violet, Methyl Green, Erythrocin B, Basic Fuchsine; Malachite Green, Oil Red, m-Cresol Purple, Rhodamine B, Auramine, 4-p-diethyl amino phenyl iminaphthoquinone, cyano-p-diethyl amino phenyl acetoanilide or the like as examples of discoloring agents changing from chromic to achromic or differently chromic tones.

On the other hand, discoloring agents changing from achromic tones to chromic tones include leuco pigments and primary or secondary aryl amine-based pigments represented by triphenyl amine, diphenyl amine, o-chloroaniline, 1, 2, 3-triphenyl guanidine, naphtyl amine, diamino diphenyl methane, p, p'-bis-dimethyl amino diphenyl amine, 1, 2-dianilinoethylene, p, p', p"-tris-dimethyl amino triphenyl methane, p, p'-bis-dimethyl animo diphenyl methyl imine, p, p', p'-triamino-o-methyl triphenyl methane, p, p"-bis-dimethyl amino diphenyl-4-anilino naphtyl methane, and p, p', p"-triamino triphenyl methane. Particularly preferably, tripheyl methane-based and diphenyl methane-based pigments are effectively employed. Further preferably, triphenyl methane-based pigments are employed. Particularly, Victoria Pure Blue BOH is employed.

A variety of additives can be further added to photosensitive compositions employed for the support element according to the present invention.

For example, there are preferably employed alkyl ethers for improving coating properties (for example, ethyl cellulose or methyl cellulose); fluorine-based surface active agents; nonionic surface active agents (in particular, fluorine-based surface active agents are preferred.); plasticizer for imparting flexibility and friction resistance of a coat film (for example, butyl phthalyl, polyethylene glycol, tributyl citrate, diethyl phthalate, dibutyl phthalate, dihexyl phthalate, dioctyl phthalate, tricresyl phosphate, tributyl phosphate, trioctyl phosphate, tetrahydrofurfuryl oleate, oligomer and polymer of acrylic acid or methacrylic acid. Among them, tricresyl phosphate is particularly preferred.); grease sensing agent for improving grease sensitivity of an image portion (for example, semi-esterification product of styrene-maleic anhydride copolymer with alcohol, novolac resin such as p-t-butyl phenol-formaldehyde resin, 50% aliphatic acid ester of p-hydroxy styrene or the like disclosed in Japanese Patent Laid-Open No. 55-527); stabilizer (for example, phosphate, phosphorous acid, organic acid (citric acid, oxalic acid, dipicolinic acid, benzene sulfonic acid, naphthalene sulfonic acid, sulfosalicylic acid, 4-methoxy-2-hydroxy benzophenone-5-sulfonic acid, tartaric acid or the like)), accelerators (for example, higher alcohol, acidic anhydride or the like).

To provide the above mentioned photosensitive components on the support element, a photosensitive diazo resin, a lipophilic polymeric compounds, and a predetermined amount of various additives as required are dissolved in appropriate solvents (methyl cellosolve, ethyl cellosolve, dimethoxy ethane, diethylene glycol monomethyl ether, diethylene glycol dimethyl ether, 1-methoxy-2-propanol, methyl cellosolve acetate, acetone, methyl ethyl ketone, methanol, dimethyl formamide, dimethyl acetoamide, cyclo hexane, dioxane, tetrahydrofuran, methyl lactate, ethyl lactate, ethylene dichloride, dimethyl sulfoxide, water or a mixture thereof and the like), a coat liquid of photosensitive compositions is adjusted, and then, the adjusted liquid may be applied onto the support element to be dried.

Although solvents to be employed may be single, a mixture of high boiling point solvents such as methyl cellosolve, 1-methoxy-2-propanol, or methyl lactate and low boiling point solvents such as methanol and methyl ethyl ketone is further preferred.

The concentration of the solid component of the photosensitive composition to be applied is desirably within the range of 1 to 50 wt. %. In this case, the applying quantity of the photosensitive composition may generally be about 0.2 to 10 $g/m^2$ (dry weight), and further preferably, may be 0.5 to 3 $g/m^2$.

[III] When a Photosensitive Layer Including Photo-dimerization Type Photosensitive Composition and Photo-polymerization Photosensitive Compositions are Provided The photo-dimerization type photosensitive compositions include polymers having maleimide group, cinnamyl group, cinnamoyl group, cinnamilidene group, cinnamilidene acetyl group, or chalcone group and the like on their side chain or main chain. Polymers having maleimide group on their side chain include polymers disclosed in the specifications of Japanese Patent Laid-Open No. 52-988 (corresponding U.S. Pat. No. 4,079,041); German Patent No. 2, 626, 769; European Patent No. 21,019, and European Patent No. 3,552; polymers disclosed in Die Angewandte Makromolekulare Chemie) 115 (1983) pp. 163 to 181; and polymers disclosed in Japanese Patent Laid-Open Nos. 49-128991, 49-128992, 49-128993, 50-5376, 50-5377, 50-5379, 50-5378, 50-5380, 53-5298, 53-5299, 53-5300, 50-50107, 51-47940, 52-13907, 50-45076, 52-121700, 50-10884, and 50-45087; German Patent Nos. 2,349,948 and 2,616,276.

In order to make these polymers soluble or. expandably wettable in alkaline water, it is useful that carboxylic acid, sulfonic acid, phosphonic acid, phosphonic acid, and alkaline metal salt or ammonium salt thereof and acid radical whose pKa is 6 to 12 dissociated in alkaline water or the like is contained in the polymers. Thirteen kinds of monomers having the above acid radicals and monomers having maleimide groups can be co-polymerized as required.

The acid value of the maleimide polymer having an acid radical is preferably within the range of 30 to 300. Among the polymers having such acid value, a copolymer between N-[2-(methacryloiloxy) ethyl]-2, 3-dimethyl maleimide and methacrylic acid or acrylic acid disclosed in Die Angewandte Makromolekulare Chemie 128 (1984) pp. 71 to 91 is useful. Further, in synthesizing this copolymer, a vinyl monomer being a third component is co-polymerized, thereby making it possible to easily synthesize a multiple co-polymer according to its purpose. For example, as a vinyl monomer being the third component, alkyl methacrylate or alkyl acrylate whose homopolymer's glass transfer point is below room temperature is employed, thereby making it possible to impart flexibility to the copolymer.

Photo-cross linking polymers having a cinnamyl group, a cinnamoyl group, a cinnamylidene group, a cinnamylidene acetyl group or a chalcone group and the like on its side or main chain include photosensitive polyesters disclosed in the specifications of U.S. Pat. No. 3,030,208, U.S. patent applications Ser. No. 709,496, and 828,455.

Polymers produced by making these photo-cross linking polymers alkali-soluble are as follows:

That is, photosensitive polymers as disclosed in Japanese Patent Laid-Open No. 60-191244 can be exemplified.

Further, photosensitive polymers or the like disclosed in Japanese Patent Laid-Open Nos. 62-175729, 62-175730, 63-25443, 63-218944, and 63-218945 can be exemplified.

Furthermore, sensitizing agents can be used for a photosensitive layer including these polymers. Such senstilizing agents include benzophenone derivative, benzanthrone derivative, quinones, aromatic nitride compound, naphthothiazoline derivative, benzothiazoline derivative, thioxanthones, naphthothiazol derivative, keto-coumarin compound, benzothiazol derivative, naphthofuranone compound, birylium salt, thiabirylium salt or the like. For such photosensitive layer, there can be used, as required, copolymers with at least one kind of monomers such as chlorinated polyethylene, chlorinated polypropylene, alkyl polyacrylate ester, alkyl acrylate ester, acrylonitryl, vinyl chloride, styrene, butadiene; binders such as polyamide, methyl cellulose, polyvinyl formal, polyvinyl butyral, methacrylic acid copolymer, acrylic acid copolymer, and itaconic acid copolymer; dialkyl phthalate ester such as dibutyl phthalate or dihexyl phthalate; or plasticizer such as oligo ethylene glycol alkyl ester or phosphate ester. In addition, for the purpose of coloring of the photosensitive layer, it is preferable that pH support medicine is added as a dye or pigment or a burning agent.

Photo-polymeric photosensitive compositions include unsaturated carboxylic acid and its salt; ester of unsaturated carboxylic acid and aliphatic polyvalent alcohol compound; and amide of unsaturated carboxylic acid and aliphatic polyvalent amine compound.

Photo-polymerization initiators include bicynal polytaketardonyl compound, α-carbonyl compound, acyloin ether, aromatic acyloin compound substituted by hydrocarbon on α-position, polynuclear quinone compound, a combination of triarylimidazol dimer and p-amino phenyl ketone, benzothiazol based compound, trihalomethyl-s-triazine compound, acridine and phenazine compound, oxadiazol compound or the like. Together with these compounds, polymers soluble or expandably wettable in alkaline water and capable of being filmed include a copolymer of benzyl (meta) acrylate/(meta) acrylic acid/other added polymeric vinyl monomer, as required; a copolymer of methacrylic acid/methyl methacrylic acid (or methacrylate ester acid); and a copolymer having pentaerythritol triacrylate added to maleic anhydride copolymer through semi-esterification or acidic vinyl copolymer and the like.

[IV] Photosensitive Layer for Electronic Photography

For example, a ZnO photosensitive layer disclosed in the specification of U.S. Pat. No. 3,001,872 can be employed. In addition, photosensitive layers employing an electronic photography photosensitive elements disclosed in Japanese Patent Laid-Open Nos. 56-161550, 60-186847, and 61-238063 may be employed.

The quantity of the photosensitive layer provided on the support element is within the range of about 0.1 to about 7 $g/m^2$ in dry weight after application, and preferably, is within the range of 0.5 to 4 $g/m^2$.

In a method for manufacturing a planographic printing plate support element according to the present invention, an intermediate layer may be provided as required for the purpose of improving adhesion between the support element and photosensitive layer; preventing a photosensitive layer from remaining after development; or preventing halation or the like.

For the improvement of adhesion, in general, an intermediate layer is made of a diazo resin or phosphate compound adsorbed by aluminum, amino compound, carboxylic acid compound or the like. In order to prevent the photosensitive layer from remaining after development, the intermediate layer made of a substance with its high solubility is generally made of polymers with its good solubility or water-soluble polymers. For the prevention of halation, the intermediate layer generally contains dyes or UV absorbent. The thickness of the intermediate layer is arbitrary, and must be capable of being subject to uniform bonding and forming reaction with the upper photosensitive layer during exposure. In general, the applying rate of about 1 to 100 $mg/m^2$ in dry solid is appropriate, and particularly, the rate of 5 to 40 $mg/m^2$ is appropriate.

In addition, as photosensitive materials capable of infrared-ray laser recording, there can be employed, A. negative infrared-ray laser recording material; B. positive infrared-ray laser recording material; C. photopolymeric photopolymer type (negative infrared-ray laser recording material; D. photo-cross linking photopolymer type (negative) infrared-ray recording material; E. sulfonated (positive) infrared-ray laser recording material; and F. electrophotographic photosensitive resin based infrared-ray laser recording material or the like. Hereinafter, each of these materials will be described in detail.

[Negative Infrared-ray Recording Material]

As an effective printing plate material capable of negative infrared-ray laser exposure, there can be employed a composition consisting of: (A) a compound optically or thermally decomposed to generate an acid; (B) a cross linking agent cross-linked by the acid; (C) an alkali soluble resin; (D) an infrared-ray absorbent; and (E) a compound expressed by the general formula (R1-X) n—Ar—(OH) m (wherein R1 denotes an alkyl group or an alkenyl group of C6 to C32; X denotes single bond, 0, S, COO, or CONH; and Ar denotes an aromatic hydrocarbon group, aliphatic hydrocarbon group, or heterocyclic group, and n=1 to 3 and m=1 to 3). With respect to this negative printing plate material, it has been expected to solve a disadvantage that the material is easily finger-printed after the developing process, and the strength of an image portion is weak. This disadvantage can be eliminated by the present invention. Hereinafter, the constituent elements of this negative printing plate material will be described in detail.

(A) Compounds optically or thermally decomposed to generate an acid include a compound optically decomposed to generate sulfonic acid, which is represented by imino sulfonate or the like described in the specification of Japanese Patent Application No. 3-140109. This compound generates an acid by irradiation of 200 to 500 nm in wavelength or heating of 100° C. or above. As a preferable acid generating agent, there are employed a photo cation polymerization initiator, photo-radical polymerization initiator, photo de-coloring agent for pigments or the like, photo discoloring agent or the like. These acid generating agents are added to all solid components of an image recording material by 0.01 to 50 wt. %.

(B) Cross linking agents cross-linked by an acid preferably include: (i) an aromatic compound substituted by an alkoxy methyl group or a hydroxyl group; (ii) a compound having an N-hydroxy methyl group, an N-alkoxy methyl group, or an N-acyl oxymethyl group; and (iii) an epoxy compound.

(C) Alkali soluble resins include a novolac resin or a polymer having a hydroxy aryl group on its side chain.

(D) Compositions consisting of infrared-ray absorbent include: commercially available dyes such as azo dyes for effectively absorbing red infrared rays of 760 to 1200 nm, anthraquinone dyes, phthalocyanine dyes; or black pigments, red pigments, metal powder pigments, phthalocyanine based pigments described in color index. In addition, it is preferable to add an image coloring agent such as Oil Yellow or Oil Blue #603 in order to improve the appearance of an image. Further, for the purpose of improving flexibility of a coated film, plasticizer such as polyethylene glycol or phthalic acid ester can be added.

[Positive Infrared-ray Laser Recording Material]

As a printing plate material capable of effective positive infrared-ray laser exposure, there can be employed a positive photosensitive material for infrared-ray laser consisting of: a compound in which (A) an alkali soluble polymer is compatible with (B) a nucleus alkali soluble polymer, thereby lowering alkali decomposition properties; and a compound for absorbing (C) infrared-ray laser. As a positive printing plate material, it has been expected to introduce a planographic printing plate which is capable of solving the insufficiency of compatibility with an alkali developing solution at a non-image portion; which is hardly damaged; which is superior in alkali development resistance at an image portion; and which is good in development stability. According to the present invention, these disadvantages can be eliminated. Hereinafter, the constituent elements of this positive printing plate material will be described in detail.

(A) Alkali soluble polymers preferably include (1) a polymer having a phenol based hydroxide group represented by a phenol resin, a cresol resin, a novolac resin, or pyrogallol resin and the like; (2) a compound obtained by co-polymerizing a polymerized monomer having a sulfonic amide group with a single or another polymeric monomer; and (3) a compound having in a molecule an active imido group represented by N- (p-toluene sulfonyl) methacryl amide or N- (p-toluene sulfonyl) acryl amide or the like.

(B) Components include a sulfonic compound, an ammonium salt, a sulfonium salt; an amide compound, and a compound mutually acting with the component of the above (A). For example, in the case where the component of (A) is a novolac resin, a cyanine pigments are preferred.

(C) As a component, it is preferable to employ a material having an absorption area in an infrared-ray area of 750 to 1200 nm and having light/heat converting capability. The materials having such capability include squarilium pigments, pyrilium salt pigmments, carbon black, insoluble azo dyes, anthraquinone based dyes or the like.

This pigment is preferable within the range of 0.01 $\mu$m to 10 $\mu$m in size. The dye is added to the pigment, and methanol, methyl ethyl ketone or the like is employed as an organic solvent to dissolve them. Then, the solution is coated onto an aluminum plate, and the aluminum plate is provided after the plate has been dried (weight after dry: 1 to 3 g/m$^2$).

[Photo-polymeric Photo-polymer Type Laser Recording Material]

Further effective printing plate materials capable of laser exposure include use of photo-polymeric photo-polymer photosensitive material.

Prior to applying a photo-polymeric photosensitive layer, in order to improve adhesive force to an aluminum support body, it is preferable to provide an adhesive layer containing silicone compounds each having a reactive functional group disclosed in Japanese Patent Laid-Open Nos. 3-56177 and 8-320551 provided on the aluminum support body. That is, a silane compound such as ethylene tetramethoxy silane or ethylene tetraethoxy silane or the like is dissolved in a solvent such as methanol or ethanol at a rate of 1 to 20 wt. %, and is hydrolyzed under an acidic catalyst such as hydrochloric acid, nitric acid, phosphorous acid, sulfonic acid. A bond of —Si—02—Si— is formed, and solation is obtained. The solation is provided on the aluminum support body. At this time, the solation is dissolved in an appropriate solvent (such as methanol), whereby the solation is adjusted to viscosity of 0.2 CP to 20 P, and the applying weight after dry is set in the range of 1 to 100 mg/m$^2$.

Provided thereon is a polymeric compound having its additional polymerization unsaturated bonding properties (a compound having its tip end ethylenically photo-polymeric group), which includes a photo-polymerization initiator, an organic polymer bonding agent, a coloring agent, a plasticizer, a thermal polymerization inhibitor or the like. Compounds having tip end ethylenically unsaturated bonding properties include esters between an unsaturated carbonic acid and an aliphatic polyvalent alcohol compound (ester acrylate, ester methacrylate, ester itaconate, ester maleate or the like); and an amide between the unsaturated carbonic acid and aliphatic polyvalent amine compound (methylene bis acryl amide, xylene bis acryl amide or the like). Sensitizers such as Titanocene compounds, triadine based, benzophenone based, and penzoimidasol based agents can be used for photo-polymerization initiators. In addition, sensitizers such as cyanine pigment, merocyanine pigment, xanthene pigment, coumarine pigment or the like can be used.

A photosensitive component having such composition is provided on the aluminum support body by 1 to 3 g/m$^2$, whereby a negative laser printing plate capable of infrared-ray laser exposure can be prepared.

[Photo-Cross linking Photo-polymer Type Laser Recording Material]

For example, polyester compounds disclosed in Japanese Patent Laid-Open No. 52-96696 and polyvinyl cynnamate based resins described in the specification of British Patent No. 1,112,277 are preferred. In particular, a material having a maleimide group on its side chain, which is described in Japanese Patent Laid-Open No. 62-78544, is preferred.

[Sulfonate Type Infrared-ray Recording Material]

For example, there can be employed photosensitive materials in which sulfonate compounds disclosed in Japanese Patent Publication Nos. 270480 and 2704872 or the like is soluble in water by generating a sulfonic acid by a heat generated by infrared-ray laser irradiation; photosensitive materials in which a styrene sulfonic acid ester is bound by sol gel, and is subjected to infrared-ray laser irradiation, whereby a surface polarity is changed; and photosensitive materials or the like in which a hydrophobic surface is changed to be hydrophilic by laser exposure described in each of the specifications of Japanese Patent Application Nos. 9-89816, 10-22406, and 10-027655. It is also possible to use the following method for further improving characteristics of a recording layer consisting of polymeric compounds in which a sulfonic acid group is generated by a heat as described above.

Specific examples of such improved methods can include a method using acids or base generating agents described in the specification of Japanese Patent Application No. 10-7062; a method for providing a specific layer described in the specification of Japanese Patent Application No. 9-340358; use of specific cross linking agents described in the specification of Japanese Patent Application No. 9-248994; a method for forming a specific layer structure described in the specification of Japanese Patent Application No. 10-43921; and a method used in the modified mode of a solid particle surface described in the specification of Japanese Patent Application No. 10-115354 or the like.

Other examples of compositions for a planographic printing plate causing hydrophilic or hydrophobic properties of a photosensitive layer to be changed by utilization of a heat generated by laser exposure include, for example, a composition capable of changing to hydrophobic properties by a heat consisting of a Werner complex described in the specification of U.S. Pat. No. 2,764,085; a composition capable of changing to hydrophilic properties by exposure to a specific sugar, melamin formaldehyde resin or the like described in Japanese Patent Publication No. 46-27219; a composition capable of changing to hydrophobic properties by heat mode exposure described in Japanese Patent Laid-Open No. 51-63704; a composition consisting of a polymer that can be dehydrated to be hydrophobic due to a heat from a phthalyl hydrazide polymer described in the specification of U.S. Pat. No. 4,081,572; a composition that can be made hydrophilic due to a heat having a tetra zolium salt structure described in Japanese Patent Publication No. 3-58100; a composition that can be made hydrophobic due to exposure consisting of a sulfonic acid modified polymer described in Japanese Patent Laid-Open No. 60-132760; a composition that can be made hydrophobic due to exposure consisting of an imido precursor polymer described in Japanese Patent Laid-Open No. 64-3543; a composition that can be made hydrophilic due to exposure consisting of carbon fluoride polymer described in Japanese Patent Laid-Open No. 51-74706; a composition that is changed to be hydrophilic due to exposure consisting of a hydrophobic crystalline polymer described in Japanese Patent Laid-Open No. 3-197190; a composition consisting of a polymer and a light and heat converting agent in which a side group made insoluble by a heat is changed to be hydrophilic, described in Japanese Patent Laid-Open No. 7-186562; a composition made hydrophobic due to exposure consisting of a three-dimensionally cross-linked hydrophilic binder containing a micro-capsule described in Japanese Patent Laid-Open No. 7-1849; a composition capable of valence isomerization and proton movement isomerization described in Japanese Patent Laid-Open No. 8-3463; a composition causing hydrophilic and hydrophobic properties to be changed by a heat and a change of the intra-layer mutual structure (compatibilizing) described in Japanese Patent Laid-Open No. 8-141819; and a composition in which the shape of a surface is changed by a heat, whereby hydrophilic and hydrophobic properties of the surface can be changed, described in Japanese Patent Publication No. 60-228.

Another example of a preferred photosensitive layer can include a composition in which bonding properties between a photosensitive layer and a support body can be changed by utilizing a heat generated by laser light with its high power density, so-called, by heat mode exposure.

Specifically, a composition consisting of a thermally fused or thermally reactive substance described in Japanese Patent Publication No. 44-22957 can be employed.

[Electrophotographic Photosensitive Resin Based Laser Recording Material]

With respect to an electrophotographic technique, its basic patent is disclosed in Japanese Patent Publication No. 37-17162, and otherwise, methods disclosed in Japanese Patent Laid-Open No. 56-107246, Japanese Patent Publication No. 59-36259 or the like can be employed. An electrophotographic photosensitive resin consists essentially of a photo-conductive compound and a binder. In order to improve sensitivity and obtain a desired photosensitive wavelength, a publicly known pigment, dye, chemical sensitizers or any other additive can be used as required.

The thus prepared planographic printing plate is subjected to infrared-ray laser exposure, and is developed by an alkali developing solution.

A light source to be employed is an infrared-ray laser having 700 to 1200 nm.

In recent years, in printing plate manufacturing and printing industries, an automatic developing machine for a planographic printing plate is widely employed for efficient and standardized plate printing work. In the present invention, such automatic developing machine is preferably employed.

For an exposed planographic printing plate, there can be used a developing solution consisting essentially of alkali silicate such as soda silicate or potassium silicate described in Japanese Patent Laid-Open No. 54-62004; and a developing solution consisting essentially of non-reducing sugar such as saccharose, trehalose or the like which does not have a free radical aldehyde group and ketone group, and does not exhibit reducing properties, described in Japanese Patent Laid-Open No. 8-305039. In addition, there can be added an alkali agent such as potassium hydroxide; a development stabilizer such as polyethylene glycol addition of sugar alcohol disclosed in Japanese Patent Laid-Open No. 6-282079; reduction agent such as hydroquinone; water softener such as ethylene diamine; nonionic and/or anionic amphoteric surface active agent; or polyoxyethylene polyoxypropylene block polymerized surface active agent disclosed in Japanese Patent Publication No. 3-54339.

In the case of alkali silicate, the molar rate is preferably 0.3 to 3.0 of $SiO_2/M_2O$ (M represents an alkali metal). Si can be deposited on a surface by this developing treatment.

In addition, it is possible to measure an amount of element Si existing on the surface by ESCA. Amounts of C., Al, O, S, Si, and Ca are measured, and are calculated as their element rate (atm. %). In the present invention, the amount of Si is preferably 1 to 25 atm. %, and in particular, is preferably 5 to 20 atm. %. When the amount of Si is within this range, it is effective to prevent halation during infrared-ray laser light irradiation.

On the other hand, in the case of a developing solution consisting essentially of a non-reductive suger, it is required to make the surface of an aluminum support body hydrophilic through silicate treatment or the like. In this case also, the amount of Si deposited to the surface after development is preferably 1 to 25 atm. %.

In the foregoing, development is preferably carried out by using an automatic developing machine. A replenishment solution having its alkali strength stronger than a developing solution is added to the developing solution, whereby developing process can be carried out stably for a long period of time.

To this replenishment solution, an anionic surface active agent can be added in order to enhance dispersion of development dust or ink-philic properties at a printing image portion. Further, a antifoaming agent or a water softener can be added as required.

A developed surface is post-treated by a rinse liquid having a surface active agent or a non-inductive greasing solution containing gum. arabic or starch derivative. When an aqueous solution containing gum arabic or starch derivative by 5 to 15 wt. % in concentration of solid component is used, a surface after development is protected so that a wet applying quantity is 1 to 10 $cc/m^2$. A dry film is preferably 1 to 5 $g/m^2$ in weight.

In addition, in the case where higher printing resistance is required, burning treatment described in Japanese Patent Publication No. 61-2518 can be carried out. A surface treatment liquid disclosed in Japanese Patent Publication No. 55-28062 is applied to a printing plate surface with sponge or absorbent cotton or is applied with the aid of an automatic coating mechanism. In the case of the surface treatment liquid, the appropriate dry weight thereof is generally 0.3 to 0.8 $g/m^2$. A mat layer comprised of independently provided protrusions can be provided on such applied photosensitive layer.

An object of the mat layer is to reduce the vacuum drawing time, and further, prevent the crash of microscopic net dots during exposure due to a contact failure by improving vacuum contact properties between a negative image film and a photosensitive planographic printing plate in contact exposure.

Methods for coating the mat layer include a method for thermally fusing powdered solid powders described in Japanese Patent Laid-Open No. 55-12974; a method for spraying polymer-containing water, thereby drying the mat layer described in Japanese Patent Laid-Open No. 58-182636. Although any method is available in use, it is desirable that the mat layer itself is substantially dissolved in an aqueous alkali developing solution free of containing an organic solvent or an exposure portion can be removed in this manner.

The thus prepared photosensitive planographic printing plate is subjected to image exposure, and a resin image is formed by treatment including developing treatment by using a generally available technique. For example, in the case of the photosensitive planographic printing plate having a photosensitive layer of [1], after image exposure, an exposure portion is removed by developing an image with an alkaline aqueous solution as described in the specification of U.S. Pat. No. No. 4,259,434, and a planographic printing plate is obtained. In the case of a photosensitive planographic printing plate having a photosensitive layer of [2], after image exposure, a photosensitive layer free of exposure is removed by developing an image using a developing solution as described in the specification of U.S. Pat. No. No. 4,186,006, and a planographic printing plate is obtained. In addition, there can be used an aqueous alkali developing solution composition employed for developing positive planographic printing plates as described in Japanese Patent Laid-Open Nos. 59-84241, 57-192952, and 62-24263.

EXAMPLES

Examples 1 to 4

An aluminum plate made of a JIS 1050 material was used. An apparatus described in Japanese Patent Publication No. 50-40047 was employed, and a brush roll bundled with 6 to 10 nylons of about 0.25 mm in diameter was rotated at a rotation frequency of 250 rpm. Then, the plate was subjected to mechanical graining by employing a slurry solution in which $Al_2O_3$ and $SiO_2$-containing a polishing agent of 35 $\mu$m on average size was liquid-prepared to be 15% in specific volume. The average surface roughness was measured at 0.49 $\mu$m. Then, the treatment time was adjusted so as to obtain a dissolution quantity of 7 g/m$^2$ while a caustic soda concentration was 20% and a temperature was 60° C., and etching treatment was carried out. Thereafter, the plate was washed with water, and was subjected to de-smut treatment at a liquid temperature of 30° C., the liquid containing nitrate of 10 g/l and aluminum of 1 g/l. Then, while all of the roller insulating properties were set to 0.01 MΩ or more using the apparatus of FIG. 1, and a temperature was maintained to 45° C., an electrolyte containing a nitrate of 10 g/l and an aluminum of 1 g/l was prepared, and a circulation quantity was set to be at a flow rate of 0.6 m per second. A power supply device shown in FIG. 3 was used, a main opposite electrode was made of graphite, and an auxiliary opposite electrode was made of ferrite. Power supply waveforms were symmetrical waveforms, and a time for a current to reach a peak value was set to 0.5 millisecond. The current conditions were set as shown in Table 1 below.

TABLE 1

| Examples | Total electricity quantity | Auxiliary electrode electricity quantity | Current density | Frequency |
|---|---|---|---|---|
| 1 | 250 c/d m$^2$ | 2 c/d m$^2$ | 25 A/d m$^2$ | 60 Hz |
| 2 | 290 c/d m$^2$ | 25 c/d m$^2$ | 30 A/d m$^2$ | 50 Hz |
| 3 | 210 c/d m$^2$ | 10 c/d m$^2$ | 7 A/d m$^2$ | 70 Hz |
| 4 | 280 c/d m$^2$ | 15 c/d m$^2$ | 48 A/d m$^2$ | 80 Hz |

Then, the aluminum plate was washed with water. While the concentration of caustic soda was maintained to 15%, and a temperature was maintained to 45° C., etching treatment was carried out so as to obtain a dissolution quantity of 0.9 g/m$^2$. Thereafter, the plate was washed with water, and an anode oxidization film of 2.5 $\mu$m$^2$ was prepared at a sulfate percentage of 15%, at aluminum weight of 10 g/l, and at a temperature of 40° C.

Examples 5 to 8

A JIS 1050 aluminum material was subjected to etching treatment by adjusting the treatment time so as to obtain a dissolution quantity of 4g/m$^2$ while the concentration of caustic soda was 20%, and a temperature was 60° C. Then, the aluminum material was washed with water, and was subjected to de-smut treatment at a liquid temperature of 30° C., the liquid containing nitrate of 12 g/l and aluminum of 1 g/l. Thereafter, all of the roller insulating properties were set to 0.01 MΩ or more using the apparatus of FIG. 1. While a temperature was mailtained to 40° C., an electrolyte containing nitrate of 12 g/l and aluminum of 1 g/l was prepared, and a circulation quantity was set to be at a flow rate of 0.6 m per second. A power supply device shown in FIG. 3 was used, a main opposite eletrode was made of graphite, and an auxiliary opposite electrode was made of ferrite. Power supply waveforms were symmetrical waveforms, and the time for a current to reach a peak value was 0.5 millisecond. The current conditions were established as shown in Table 2 below.

TABLE 2

| Examples | Total electricity quantity | Auxiliary electrode electricity quantity | Current density | Frequency |
|---|---|---|---|---|
| 5 | 290 c/d m$^2$ | 2 c/d m$^2$ | 28 A/d m$^2$ | 60 Hz |
| 6 | 320 c/d m$^2$ | 25 c/d m$^2$ | 22 A/d m$^2$ | 50 Hz |
| 7 | 410 c/d m$^2$ | 10 c/d m$^2$ | 7 A/d m$^2$ | 70 Hz |
| 8 | 180 c/d m$^2$ | 10 c/d m$^2$ | 48 A/d m$^2$ | 80 Hz |

Then, the aluminum material was washed with water. While the concentration of caustic soda was maintained to 15%, and a temperature was maintained to 45° C., the aluminum material was subjected to etching treatment so as to obtain a dissolution quantity of 0.1 g/m$^2$. Thereafter, the aluminum material was washed with water, and an anode oxidization film of 1.5 g/m$^2$ was prepared at a sulfate percentage of 15%, at an aluminum weight of 10 g/l, and at a temperature of 40° C.

Comparative Examples 1 and 2

An aluminum plate made of a JIS 1050 material was used. An us described in Japanese Patent Publication No. 50-40047 was employed, rush roll bundled with 6 to 10 nylons of about 0.25 mm in diameter was rotated at a rotation frequency of 250 rpm. Then, the plate was subjected to mechanical graining by employing a slurry solution in which $Al_2O_3$ and $SiO_2$-containing a polishing agent of 35 $\mu$m on average size was liquid-prepared to be 15% in specific volume. The average surface roughness was measured at 0.49 $\mu$m. Then, the treatment time was adjusted so as to obtain a dissolution quantity of 7 g/m$^2$ while a caustic soda concentration was 20% and a temperature was 60° C., and etching treatment was carried out. Thereafter, the plate was washed with water, and was subjected to de-smut treatment at a liquid temperature of 30° C., the liquid containing nitrate of 10 g/l and aluminum of 1 g/l. Then, while all of the roller insulating properties were set to 0.01 MΩ or more using the apparatus of FIG. 4, and a temperature was maintained to 45° C., an electrolyte containing a nitrate of 10 g/l and an aluminum of 1 g/l was prepared, and a circulation quantity was set to be at a flow rate of 0.6 m per second. A power supply device shown in FIG. 3 was used, a main opposite electrode was made of graphite, and an auxiliary opposite electrode was made of ferrite. Power supply waveforms were symmetrical waveforms, and a time for a current to reach a peak value was set to 0.5 millisecond. The current conditions were set as shown in Table 3 below.

TABLE 3

| Comparative Examples | Total electricity quantity | Auxiliary electrode electricity quantity | Current density | Frequency |
|---|---|---|---|---|
| 1 | 250 c/d $m^2$ | 2 c/d $m^2$ | 25 A/d $m^2$ | 60 Hz |
| 2 | 290 c/d $m^2$ | 25 c/d $m^2$ | 30 A/d $m^2$ | 50 Hz |

Then, the aluminum plate was washed with water. While the concentration of caustic soda was maintained to 15%, and a temperature was maintained to 45° C., etching treatment was carried out so as to obtain a dissolution quantity of 0.9 g/$m^2$. Thereafter, the plate was washed with water, and an anode oxidization film of 2.5 g/$m^2$ was prepared at a sulfate percentage of 15%, at aluminum weight of 10 g/l, and at a temperature of 40° C.

Comparative Examples 3 and 4

A JIS 1050 aluminum material was subjected to etching treatment by adjusting the treatment time so as to obtain a dissolution quantity of 4 g/$m^2$ while the concentration of caustic soda was 20%, and a temperature was 60° C. Then, the aluminum material was washed with water, and was subjected to de-smut treatment at a liquid temperature of 30° C., the liquid containing nitrate of 12 g/l and aluminum of 1 g/l. Thereafter, all of the roller insulating properties were set to 0.001 MΩ or more using the apparatus of FIG. 1. While a temperature was maintained to 40° C., an electrolyte containing nitrate of 12 g/l and aluminum of 1 g/l was prepared, and a circulation quantity was set to be at a flow rate of 0.6 m per second. A power supply device shown in FIG. 3 was used, a main opposite electrode was made of graphite, and an auxiliary opposite electrode was made of ferrite. Power supply waveforms were symmetrical waveforms, and the time for a current to reach a peak value was 0.5 millisecond. The current conditions were established as shown in Table 4 below.

TABLE 4

| Comparative Examples | Total electricity quantity | Auxiliary electrode electricity quantity | Current density | Frequency |
|---|---|---|---|---|
| 3 | 290 c/d $m^2$ | 2 c/d $m^2$ | 28 A/d $m^2$ | 60 Hz |
| 4 | 320 c/d $m^2$ | 25 c/d $m^2$ | 22 A/d $m^2$ | 50 Hz |

Then, the aluminum material was washed with water. While the concentration of caustic soda was maintained to 15%, and a temperature was maintained to 45° C., the aluminum material was subjected to etching treatment so as to obtain a dissolution quantity of 0.1 g/$m^2$. Thereafter, the aluminum material was washed with water, and an anode oxidization film of 1.5 g/$m^2$ was prepared at a sulfate percentage of 15%, at an aluminum weight of 10 g/l, and at a temperature of 40° C.

Comparative Examples 5 to 8

An aluminum plate made of a JIS 1050 material was used. An apparatus described in Japanese Patent Publication No. 50-40047 was employed, and a brush roll bundled with 6 to 10 nylons of about 0.25 mm in diameter was rotated at a rotation frequency of 250 rpm. Then, the plate was subjected to mechanical graining by employing a slurry solution in which $Al_2O_3$ and $SiO_2$-containing a polishing agent of 35 μm on average size was liquid-prepared to be 15% in specific volume. The average surface roughness was measured at 0.49 μm. Then, the treatment time was adjusted so as to obtain a dissolution quantity of 7 g/$m^2$ while a caustic soda concentration was 20% and a temperature was 60° C., and etching treatment was carried out. Thereafter, the plate was washed with water, and was subjected to de-smut treatment at a liquid temperature of 30° C., the liquid containing nitrate of 10 g/l and aluminum of 1 g/l. Then, while all of the roller insulating properties were set to 0.01 MΩ or more using the apparatus of FIG. 4, and a temperature was maintained to 45° C., an electrolyte containing a nitrate of 10 g/l and an aluminum of 1 g/l was prepared, and a circulation quantity was set to be at a flow rate of 0.6 m per second. A power supply device shown in FIG. 3 was used, a main opposite electrode was made of graphite, and an auxiliary opposite electrode was made of ferrite. Power supply waveforms were symmetrical waveforms, and a time for a current to reach a peak value was set to 0.5 millisecond. The current conditions were set as shown in Table 5 below.

TABLE 5

| Comparative Examples | Total electricity quantity | Auxiliary electrode electricity quantity | Current density | Frequency |
|---|---|---|---|---|
| 5 | 250 c/d $m^2$ | 1 c/d $m^2$ | 25 A/d $m^2$ | 60 Hz |
| 6 | 290 c/d $m^2$ | 30 c/d $m^2$ | 80 A/d $m^2$ | 50 Hz |
| 7 | 210 c/d $m^2$ | 10 c/d $m^2$ | 4 A/d $m^2$ | 70 Hz |
| 8 | 280 c/d $m^2$ | 15 c/d $m^2$ | 52 A/d $m^2$ | 80 Hz |

Then, the aluminum plate was washed with water. While the concentration of caustic soda was maintained to 15%, and a temperature was maintained to 45° C., etching treatment was carried out so as to obtain a dissolution quantity of 0.9 g/$m^2$. Thereafter, the plate was washed with water, and an anode oxidization film of 2.5 g/$m^2$ was prepared at a sulfate percentage of 15%, at aluminum weight of 10 g/l, and at a temperature of 40° C.

Comparative Examples 9 to 12

A JIS 1050 aluminum material was subjected to etching treatment by adjusting the treatment time so as to obtain a dissolution quantity of 4 g/$m^2$ while the concentration of caustic soda was 20%, and a temperature was 60° C. Then, the aluminum material was washed with water, and was subjected to de-smut treatment at a liquid temperature of 30° C., the liquid containing nitrate of 12 g/l and aluminum of 1 g/l. Thereafter, all of the roller insulating properties were set to 0.01 MΩ or more using the apparatus of FIG. 1. While a temperature was maintained to 40° C., an electrolyte containing nitrate of 12 g/l and aluminum of 1 g/l was prepared, and a circulation quantity was set to be at a flow rate of 0.6 m per second. A power supply device shown in FIG. 3 was used, a main opposite electrode was made of graphite, and an auxiliary opposite electrode was made of ferrite. Power supply waveforms were symmetrical waveforms, and the time for a current to reach a peak value was 0.5 millisecond. The current conditions were established as shown in Table 6 below.

TABLE 6

| Comparative Examples | Total electricity quantity | Auxiliary electrode electricity quantity | Current density | Frequency |
|---|---|---|---|---|
| 9 | 290 c/d $m^2$ | 2 c/d $m^2$ | 28 A/d $m^2$ | 40 Hz |
| 10 | 320 c/d $m^2$ | 25 c/d $m^2$ | 22 A/d $m^2$ | 90 Hz |
| 11 | 410 c/d $m^2$ | 20 c/d $m^2$ | 4 A/d $m^2$ | 70 Hz |
| 12 | 180 c/d $m^2$ | 10 c/d $m^2$ | 60 A/d $m^2$ | 80 Hz |

Then, the aluminum material was washed with water. While the concentration of caustic soda was maintained to 15%, and a temperature was maintained to 45° C., the aluminum material was subjected to etching treatment so as to obtain a dissolution quantity of 0.1 g/$m^2$. Thereafter, the aluminum material was washed with water, and an anode oxidization film of 1.5 g/$m^2$ was prepared at a sulfate percentage of 15%, at an aluminum weight of 10 g/l, and at a temperature of 40° C.

With respect to Examples and Comparative Examples, continuous operation was carried out, whereby the wear and tear of an electrode or roller core metal was checked, the dirt resistance in printing performance was checked by applying a photosensitive layer, and appearance check was made.

[Comparison between Examples and Comparative Examples]

In Examples 1 to 8, the dirt resistance was good; the appearance after coating was good without any problem; no abnormality was observed with a graphite electrode, a ferrite electrode, and a roller, and continuous operation was possible.

In Comparative Examples 1 and 2, electrolytic treatment was carried out by using a conventional apparatus of FIG. 4. A ferrite electrode was slightly worn, and had to be replaced with another one.

In Comparative Examples 3 and 4, the roller insulating properties were 0.001 MΩ. An electrical contact occurred with a roller, and the roller had to be replaced with another one.

In Comparative Example 5, a graphite electrode was considerably worn, and had to be replaced with another one because an electricity quantity of an auxiliary electrode was 0.4% of the total.

In Comparative Example 6, non-uniform irregularities were obtained by an electrochemical method, and a dirt resistance level was low because an electricity quantity of an auxiliary electrode exceeded 9% of the total.

In Comparative Example 7, non-uniform irregularities were obtained by an electrochemical method, and a dirt resistance level was low because the current density was less than 5 A/$dm^2$.

In Comparative Example 8, cross streaks were considerable, and appearance was abnormal because the current density exceeded 50 A/$dm^2$.

In Comparative Example 9, a graphite electrode was considerably worn, and had to be replaced with another one because a frequency was less than 50 Hz.

In Comparative Example 10, non-uniform irregularities were obtained by an electrochemical method, and dirt resistance level was low because a frequency exceeded 80 Hz.

In Comparative Example 11, non-uniform irregularities were obtained by an electrochemical method, and dirt resistance level was low because the current density was less than 5 A/$dm^2$.

In Comparative Example 12, cross streaks were considerable, and appearance was abnormal because the current density exceeded 50 A/$d^2$.

Therefore, it was found from the above test results that an aluminum web can be roughened more uniformly, and a predetermined rough surface can be maintained by using an electrolytic treatment apparatus of FIG. 1 and setting the electricity quantity of the auxiliary opposite electrode to 0.5% to 9% of the total electricity quantity; setting the resistance value of a support roller to 0.01 MΩ or more; setting a frequency in the range of 50 to 80 Hz, and setting the current density of a main opposite electrode in the range of 5 to 50 A/$dm^2$.

As has been described above, according to an electrolytic treatment method of the present invention, a main opposite electrode and an auxiliary opposite electrode were installed in different electrolytic jars from each other; a current was supplied to the auxiliary opposite electrode by controlling a phase angle of waveforms generated by a power source for symmetrical alternating waveforms; and an electricity quantity of the auxiliary opposite electrode was set to 0.5% to 9% of the total electricity quantity of the opposite electrode, whereby a support body can be roughened more uniformly, and a predetermined rough surface can be maintained.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An electrolytic treatment method for electrolytic treatment of a target material disposed in an electrolytic treatment solution that is contained within an electrolytic jar, the solution comprising nitrate or hydrochloric acid, the method comprising:

dividing said electrolytic jar into two separate sections;

arranging and installing at least one main electrode in a first one of the two sections and an auxiliary electrode in a second one of the two sections of the electrolytic jar;

supplying electric power having an alternating current waveform to the electrodes; and setting an electric power quantity of the auxiliary electrode in the range of 0.5% to 9% of a total quantity of the electric power being supplied to the electrodes.

2. The electrolytic treatment method according to claim 1, further comprising setting a resistance value of a support member, for supporting said target material in said electrolytic jar, to at least 0.01 MΩ.

3. The electrolytic treatment method according to claim 1, further comprising setting a frequency of said alternating current waveform in a range of 50 Hz to 80 Hz, and setting a current density of said at least one main electrode in a range of 5 A/$dm^2$ to 50 A/$dm^2$.

4. The electrolytic treatment method according to claim 1, wherein the dividing completely separates the first section from the second section.

5. The electrolytic treatment method according to claim 1, wherein the supplying of electric power having an alternating current waveform to the electrodes is such that a quantity of electrical power of a forward current portion of the waveform is essentially equal to a quantity of electrical power of a reverse current portion of the waveform.

6. The electrolytic treatment method according to claim 1, further comprising controlling a phase angle of forward and reverse currents supplied to the auxiliary electrode.

7. The electrolytic treatment method according to claim 1, wherein the dividing creates two different electrolytic cells.

8. The electrolytic treatment method according to claim 1, wherein the arranging and installing at least one main electrode effects a configuration where two graphite electrodes are symmetrically disposed on opposite sides of an insulator in the first one of the two sections of the electrolytic jar.

9. The electrolytic treatment method according to claim 1, wherein the supplying of electric power having an alternating current waveform to the electrodes comprises supplying a current to the auxiliary electrode by controlling a phase angle of waveforms generated as symmetrical alternating waveforms by a power source.

* * * * *